US010651575B2

(12) United States Patent
Henry et al.

(10) Patent No.: US 10,651,575 B2
(45) Date of Patent: May 12, 2020

(54) CARD EDGE CONNECTOR ASSEMBLY WITH SUPPORT STRUCTURE

(71) Applicant: TE CONNECTIVITY CORPORATION, Berwyn, PA (US)

(72) Inventors: Randall Robert Henry, Lebanon, PA (US); Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/049,163

(22) Filed: Jul. 30, 2018

(65) Prior Publication Data

US 2019/0058270 A1 Feb. 21, 2019

Related U.S. Application Data

(60) Provisional application No. 62/545,781, filed on Aug. 15, 2017.

(51) Int. Cl.

| | |
|---|---|
| ***H01R 12/72*** | (2011.01) |
| ***H01R 12/70*** | (2011.01) |
| ***H01R 12/73*** | (2011.01) |
| *H01R 12/52* | (2011.01) |
| *H01R 13/621* | (2006.01) |
| *H01R 12/51* | (2011.01) |
| *H01R 12/00* | (2006.01) |
| *H01R 13/627* | (2006.01) |

(52) U.S. Cl.

CPC ..... *H01R 12/7029* (2013.01); *H01R 12/721* (2013.01); *H01R 12/737* (2013.01); *H01R 12/00* (2013.01); *H01R 12/51* (2013.01); *H01R 12/52* (2013.01); *H01R 12/7005* (2013.01); *H01R 13/6215* (2013.01); *H01R 13/6275* (2013.01)

(58) Field of Classification Search

CPC H01R 13/6215; H01R 12/7005; H01R 12/51; H01R 12/721; H01R 13/6275; H01R 12/00; H01R 12/52

USPC ..... 439/362, 374, 377, 327, 328, 64, 157

See application file for complete search history.

(56) References Cited

U.S. PATENT DOCUMENTS

| | | | | |
|---|---|---|---|---|
| 5,650,917 A * | 7/1997 | Hsu | H05K 7/1407 | 361/727 |
| 6,030,251 A * | 2/2000 | Stark | H01R 12/7005 | 439/377 |
| 7,955,098 B1 * | 6/2011 | McKee | H01R 12/721 | 439/157 |
| 9,331,432 B1 | 5/2016 | Phillips | | |

(Continued)

*Primary Examiner* — Abdullah A Riyami
*Assistant Examiner* — Justin M Kratt

(57) ABSTRACT

A card edge connector assembly includes a card edge connector having a housing defining a card slot receiving a paddle card of a pluggable module having a base mounted to a host circuit board holding contacts in the card slot to electrically connect to the paddle card. Support hardware is coupled to the housing having a base including a cavity receiving the card edge connector and a support beam extending from the base having a pocket receiving the pluggable module. The support beam has a support surface configured to support the pluggable module independent of the card edge connector. The support hardware has a latch coupled to the support beam latchably coupled to the pluggable module to secure the pluggable module in the support hardware electrically coupled to the card edge connector.

24 Claims, 16 Drawing Sheets

(56) References Cited

U.S. PATENT DOCUMENTS

| | | | | |
|---|---|---|---|---|
| 9,640,915 | B2 | 5/2017 | Phillips et al. | |
| 9,728,871 | B1 | 8/2017 | Gutgold et al. | |
| 9,935,385 | B2 | 4/2018 | Phillips et al. | |
| 10,218,097 | B2 | 2/2019 | Phillips et al. | |
| 10,224,652 | B2 | 3/2019 | Herring et al. | |
| 10,439,311 | B2 | 10/2019 | Phillips et al. | |
| 2015/0180174 | A1* | 6/2015 | Hirashima ..... | H01R 12/73<br>439/157 |
| 2018/0301833 | A1 | 10/2018 | Herring et al. | |

* cited by examiner

CARD EDGE CONNECTOR ASSEMBLY WITH SUPPORT STRUCTURE

CROSS REFERENCE TO RELATED APPLICATIONS

This application claims the benefit of U.S. Provisional Application No. 62/545,781 filed Aug. 15, 2017, titled CARD EDGE CONNECTOR ASSEMBLY, the subject matter of which is herein incorporated by reference in its entirety.

BACKGROUND OF THE INVENTION

The subject matter herein relates generally to card edge connector assemblies.

Card edge connectors are used in various system applications. For example, card edge connectors are typically mounted to a host circuit board. The card edge connectors include card slots for receiving a card edge of a paddle card of a pluggable module. The pluggable modules are typically stand-alone modules including electrical components thereon, such as memory, processors and the like forming electrical circuits and interacting with the host circuit board. The card edge connectors are designed for supporting the stand-alone pluggable modules.

Some system components need to be electrically connected to other components by cables. For example, header connectors may be mounted to the circuit board that electrically connect to cabled receptacle connectors. The header connectors and receptacle connectors typically have different footprints, different characteristics and different requirements than card edge connectors. For example, when installed, the cabled receptacle connectors may be subjected to stresses and strains, such as pulling forces on the cables, which are transferred to the header connector. The header connector is mounted to the host circuit board with sufficient structural stability to withstand the forces from the cabled receptacle connectors. Conventional card edge connectors are not mounted to the circuit board with sufficient structural stability to withstand forces from cable mounted pluggable modules.

Because real estate on the host circuit board is precious, it may be expensive to provide both card edge connectors and header connectors on the same circuit board to accommodate both non-cabled pluggable modules and cabled receptacle connectors. A need remains for an electrical connector that accommodates non-cabled pluggable modules and cabled receptacle connectors.

BRIEF DESCRIPTION OF THE INVENTION

In one embodiment, a card edge connector assembly is provided including a card edge connector having a housing defining a card slot configured to receive a paddle card of a pluggable module. The housing has a base configured to be mounted to a host circuit board and holds contacts in the card slot to electrically connect to the paddle card. Support hardware is coupled to the housing having a base including a cavity receiving the card edge connector. The support hardware has a support beam extending from the base having a pocket receiving the pluggable module. The support beam has a support surface configured to support the pluggable module independent of the card edge connector such that the paddle card is oriented in the card slot relative to the contacts for electrical connection therewith. The support hardware has a latch coupled to the support beam latchably coupled to the pluggable module to secure the pluggable module in the support hardware electrically coupled to the card edge connector.

In another embodiment, a card edge connector assembly is provided including a card edge connector having a housing defining a card slot configured to receive a paddle card of a pluggable module. The housing has a base configured to be mounted to a host circuit board and holds contacts in the card slot to electrically connect to the paddle card. The housing having a locating surface on an exterior of the housing. Support hardware is coupled to the housing having a base including a cavity receiving the card edge connector. The support hardware includes a locating surface in the cavity engaging the locating surface of the housing to register the location of the support hardware to the card edge connector. The support hardware has a support beam extending from the base having a pocket receiving the pluggable module. The support beam has a support surface configured to support the pluggable module independent of the card edge connector such that the paddle card is oriented in the card slot relative to the contacts for electrical connection therewith. The support hardware has a latch coupled to the support beam latchably coupled to the pluggable module to secure the pluggable module in the support hardware electrically coupled to the card edge connector.

In another embodiment, a card edge connector assembly is provided including a card edge connector having a housing defining a card slot configured to receive a paddle card of a pluggable module. The housing has a base configured to be mounted to a host circuit board and holds contacts in the card slot to electrically connect to the paddle card. Support hardware is coupled to the housing having a base including a cavity receiving the card edge connector. The support hardware has a support beam extending from the base having a pocket receiving the pluggable module. The support beam has a support surface configured to support the pluggable module independent of the card edge connector such that the paddle card is oriented in the card slot relative to the contacts for electrical connection therewith. The support hardware has a latch coupled to the support beam latchably coupled to the pluggable module to secure the pluggable module in the support hardware electrically coupled to the card edge connector. The latch is pivoted toward the pluggable module to release from the pluggable module.

DETAILED DESCRIPTION OF THE INVENTION

Figure 1:
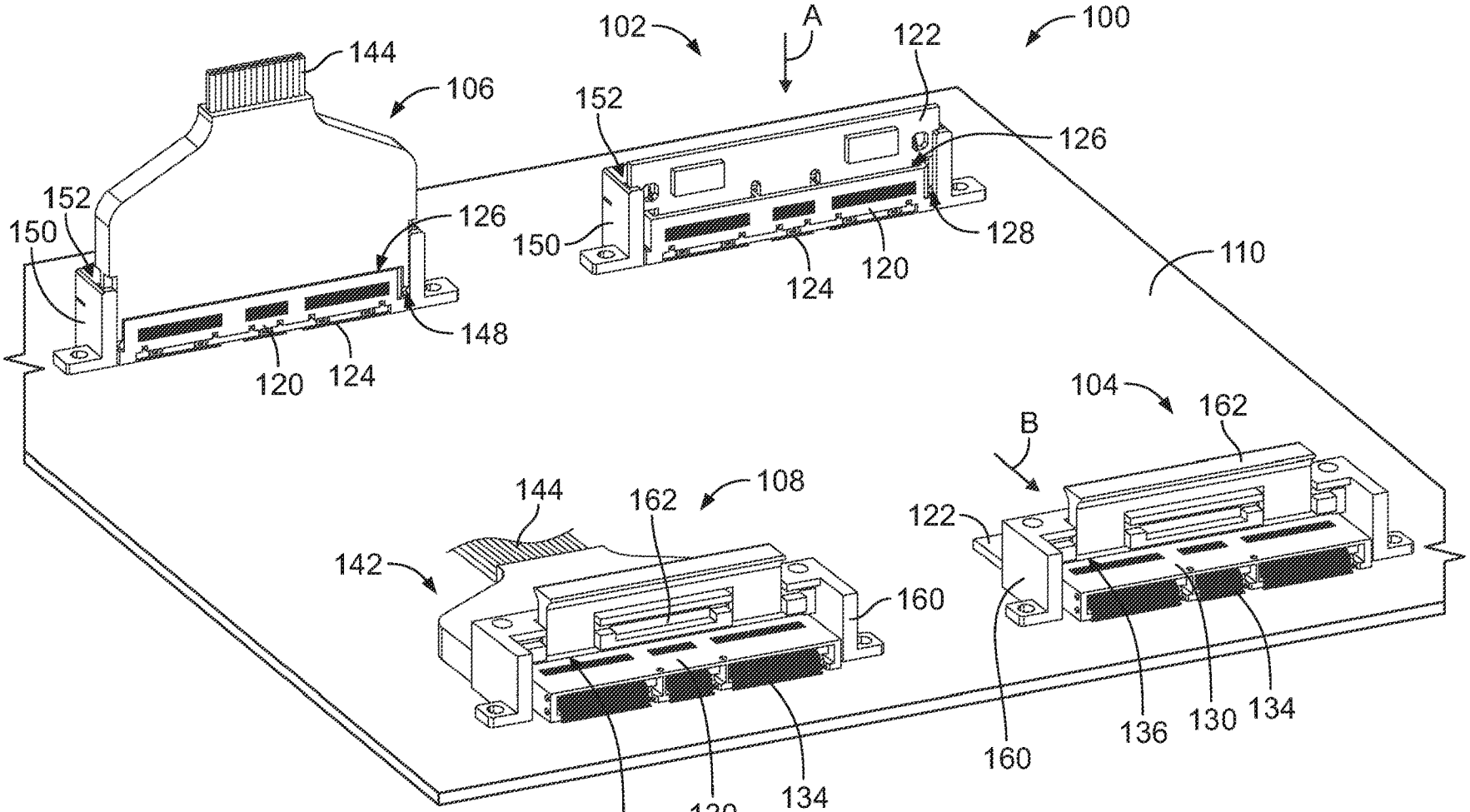
FIG. 1 is a perspective view of an electrical system showing various card edge connector assemblies in accordance with an exemplary embodiment showing the card edge connector assemblies in mated positions.
Figure 2:
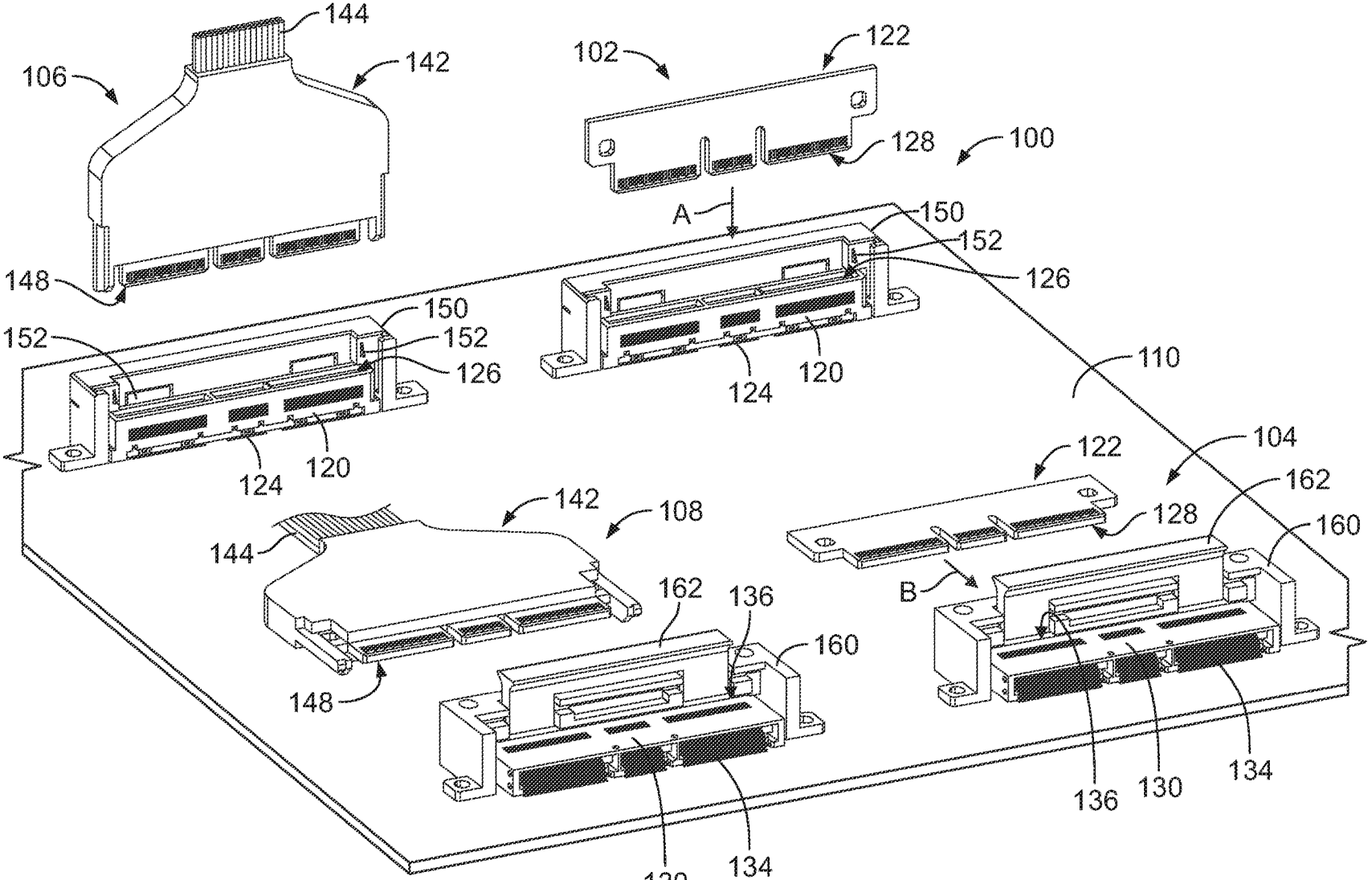
FIG. 2 is a perspective view of the electrical system showing the card edge connector assemblies in unmated positions.

FIG. 1 is a perspective view of an electrical system 100 showing various card edge connector assemblies 102, 104, 106, 108 in accordance with an exemplary embodiment showing the card edge connector assemblies 102, 104, 106, 108 in mated positions. FIG. 2 is a perspective view of the electrical system 100 showing the card edge connector assemblies 102, 104, 106, 108 in unmated positions. The card edge connector assemblies 102, 104, 106, 108 are mounted to a host circuit board 110. While FIGS. 1 and 2 illustrate four different types of card edge connector assemblies having some similar components, it is realized that any number of any of the card edge connector assemblies 102, 104, 106, 108 may be utilized within the system 100. For example, in various embodiments, only one card edge connector assembly 102, 104, 106 or 108 may be used; only one type of card edge connector assembly 102, 104, 106 or 108 may be used with multiple of such card edge connector assembly 102, 104, 106 or 108 mounted to the circuit board 110; or more than one type of card edge connector assemblies 102, 104, 106 and/or 108 may be mounted to the circuit board 110.

In the illustrated embodiment, the card edge connector assembly 102 is a vertical, non-cabled card edge connector assembly; the card edge connector assembly 104 is a horizontal, non-cabled card edge connector assembly; the card edge connector assembly 106 is a vertical, cabled card edge connector assembly; the card edge connector assembly 108 is a horizontal, cabled card edge connector assembly. Other types of card edge connector assemblies may be utilized in alternative embodiments. The card edge connector assemblies 102, 104, 106, 108 include similar components and like components may be identified using like names and like reference numbers. Not every card edge connector assembly 102, 104, 106, 108 is described herein in the same amount of detail and components described herein with reference to one of the card edge connector assemblies 102, 104, 106, 108 may be applicable to other card edge connector assemblies 102, 104, 106, 108.

The card edge connector assembly 102 includes a card edge connector 120 and a non-cabled pluggable module 122 (which may be referred to hereinafter simply as pluggable module 122). The card edge connector 120 is configured to be mounted to the host circuit board 110, such as by soldering contacts 124 of the card edge connector 120 to the host circuit board 110. The card edge connector 120 has a mating end 126 configured to receive a mating end 128 of the non-cabled pluggable module 122. The mating end 126 is provided at a top of the card edge connector 120 to receive the non-cabled pluggable module 122 in a generally vertical mating direction, such as a mating direction perpendicular to the host circuit board 110 represented by arrow A.

The card edge connector assembly 102 includes a support member for the pluggable module 122, such as support hardware 150 configured to be mounted to the host circuit board 110 adjacent the card edge connector 120 to provide guidance and support for the pluggable module 122. The support hardware 150 may be referred to as vertical support hardware because the supporting portion of the support hardware 150 extends generally vertically. The support hardware 150 may alleviate stress or strain on the card edge connector 120 from the pluggable module 122. The support hardware 150 includes a latch 152 for latchably securing the pluggable module 122 in the support hardware 150 and the card edge connector 120.

The card edge connector assembly 104 includes a card edge connector 130 and the non-cabled pluggable module 122 (while the same pluggable module 122 is illustrated in FIGS. 1 and 2, it is realized that the card edge connector assembly 104 may be configured to mate with a different type of pluggable module). The card edge connector 130 is configured to be mounted to the host circuit board 110, such as by soldering contacts 134 of the card edge connector 130 to the host circuit board 110. The card edge connector 130 has a mating end 136 configured to receive the mating end 128 of the non-cabled pluggable module 122. The mating end 136 is provided at a front of the card edge connector 130 to receive the non-cabled pluggable module 122 in a generally horizontal mating direction, such as a mating direction parallel to the host circuit board 110 represented by the arrow B.

The card edge connector assembly 104 includes a support member for the pluggable module 122, such as support hardware 160 configured to be mounted to the host circuit board 110 adjacent the card edge connector 130 to provide guidance and support for the pluggable module 122. The support hardware 160 may be referred to as horizontal support hardware because the supporting portion of the support hardware 160 extends generally horizontally. The support hardware 160 may alleviate stress or strain on the card edge connector 130 from the pluggable module 122. The support hardware 160 includes a latch 162 for latchably securing the pluggable module 122 in the support hardware 160 and the card edge connector 130.

The card edge connector assembly 106 includes the card edge connector 120 and the support hardware 150 (while the same card edge connector 120 and support hardware 150 are illustrated in FIGS. 1 and 2 as part of the card edge connector assembly 102 and the card edge connector assembly 106, it is realized that the card edge connector assembly 106 may include a different type of card edge connector or a different type of support hardware in alternative embodiments) and a cabled pluggable module 142 having cables 144 extending therefrom (which may be referred to hereinafter simply as pluggable module 142). The support hardware 150 may alleviate stress or strain on the card edge connector 120 from the cable pluggable module 142, such as from pulling forces on the cables 144. The mating end 126 of the card edge connector 120 is configured to receive a mating end 148 of the cabled pluggable module 142. The mating end 126 receives the cabled pluggable module 142 in a generally vertical mating direction, such as a mating direction perpendicular to the host circuit board 110 shown by arrow C. The cables 144 exit the pluggable module 142 generally opposite the card edge connector 120, such as vertically from the top thereof; however, the cables 144 may exit from other portions of the pluggable module 142 or in other directions, such as horizontally.

The card edge connector assembly 108 includes the card edge connector 130 and the support hardware 160 (while the same card edge connector 130 and the support hardware 160 are illustrated in FIGS. 1 and 2 as part of the card edge connector assembly 104 and the card edge connector assembly 108, it is realized that the card edge connector assembly 108 may include a different type of card edge connector or a different type of support hardware 160 in alternative embodiments). The card edge connector assembly 108 includes the cabled pluggable module 142 having the cables 144 extending therefrom (while the same cabled pluggable module 142 is illustrated in FIGS. 1 and 2 as part of the card edge connector assembly 104 and the card edge connector assembly 108, it is realized that the cabled pluggable module 142 may include a different type of card edge connector in alternative embodiments). The support hardware 160 may alleviate stress or strain on the card edge connector 130 from the cable pluggable module 142, such as from pulling forces on the cables 144. The cables 144 exit the pluggable module 142 generally opposite the card edge connector 130, such as horizontally; however, the cables 144 may exit from other portions of the pluggable module 142 or in other directions, such as vertically away from the host circuit board 110.

Figure 3:
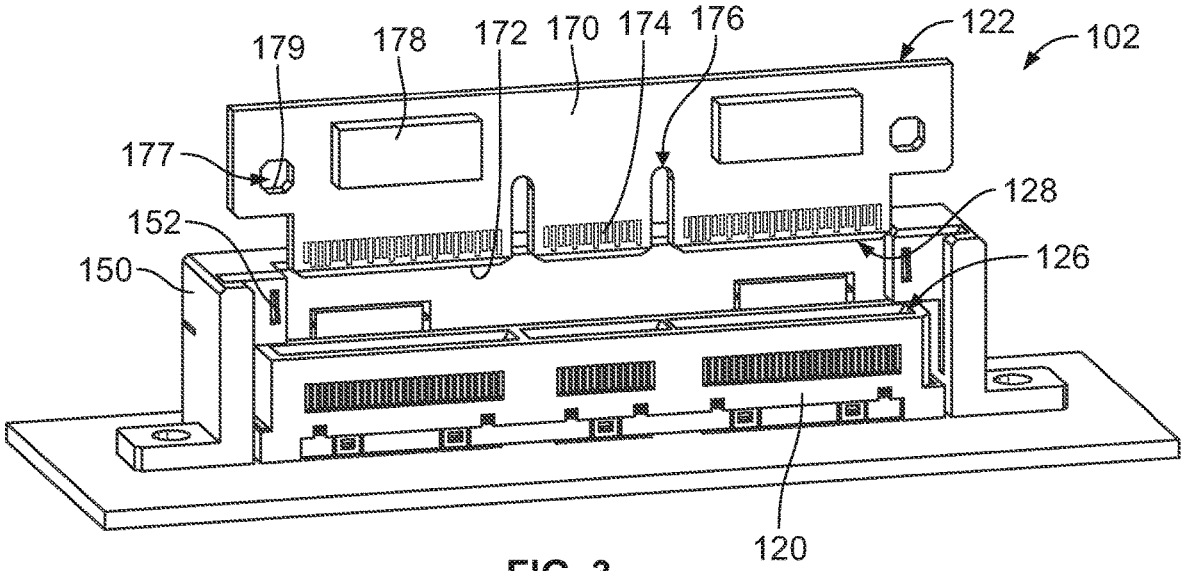
FIG. 3 is a perspective view of a card edge connector assembly showing a card edge connector, support hardware and a pluggable module in accordance with an exemplary embodiment.

FIG. 3 is a perspective view of the card edge connector assembly 102 showing the card edge connector 120, the support hardware 150 and the non-cabled pluggable module 122 in accordance with an exemplary embodiment. In an exemplary embodiment, the non-cabled pluggable module 122 is a standalone pluggable module configured to be mated with the card edge connector 120 (or the card edge connector 130 shown in FIGS. 1 and 2) without being electrically connected to another component, such as through a cabled connection. In various embodiments, the only interface the pluggable module 122 has with another component is through the card edge connector 120. The pluggable module 122 includes a paddle card 170 having a card edge 172 at the mating end 128 configured to be loaded into the card edge connector 120 or 130. The paddle card 170 has a plurality of contact pads 174 at the card edge 172 configured to be electrically connected to the card edge connector 120. In an exemplary embodiment, the paddle card 170 includes one or more alignment slots 176 in the card edge 172 for locating the paddle card 170 within the card edge connector 120. The paddle card 170 is configured to be latchably secured in the support hardware 150 (or the support hardware 160) by the latch 152. In an exemplary embodiment, the paddle card 170 includes one or more latching features 177 for latch of the engaging the latch 152. In the illustrated embodiment, the latching features 177 are openings in the paddle card 170. The latching features 177 have latching surfaces 179 configured to engage the latch 152.

The non-cabled pluggable module 122 includes one or more electrical components 178 mounted to the paddle card 170. For example, the electrical components 178 may include a memory, a processor, or other types of electrical components. The electrical components 178 are electrically connected to corresponding contact pads 174. The paddle card 170 includes various circuits transmitting data and/or power between the contact pads 174 and the electrical components 178. In various embodiments, in a simple form, the pluggable module 122 simply includes the paddle card 170 with the various electrical components 178 without any other structure. In other various embodiments, the pluggable module 122 may include a pluggable body, such as a housing, surrounding the paddle card 170 and/or the electrical components 178. The pluggable body may include one or more heat sinks for dissipating heat from the electrical components 178.

Figure 4:
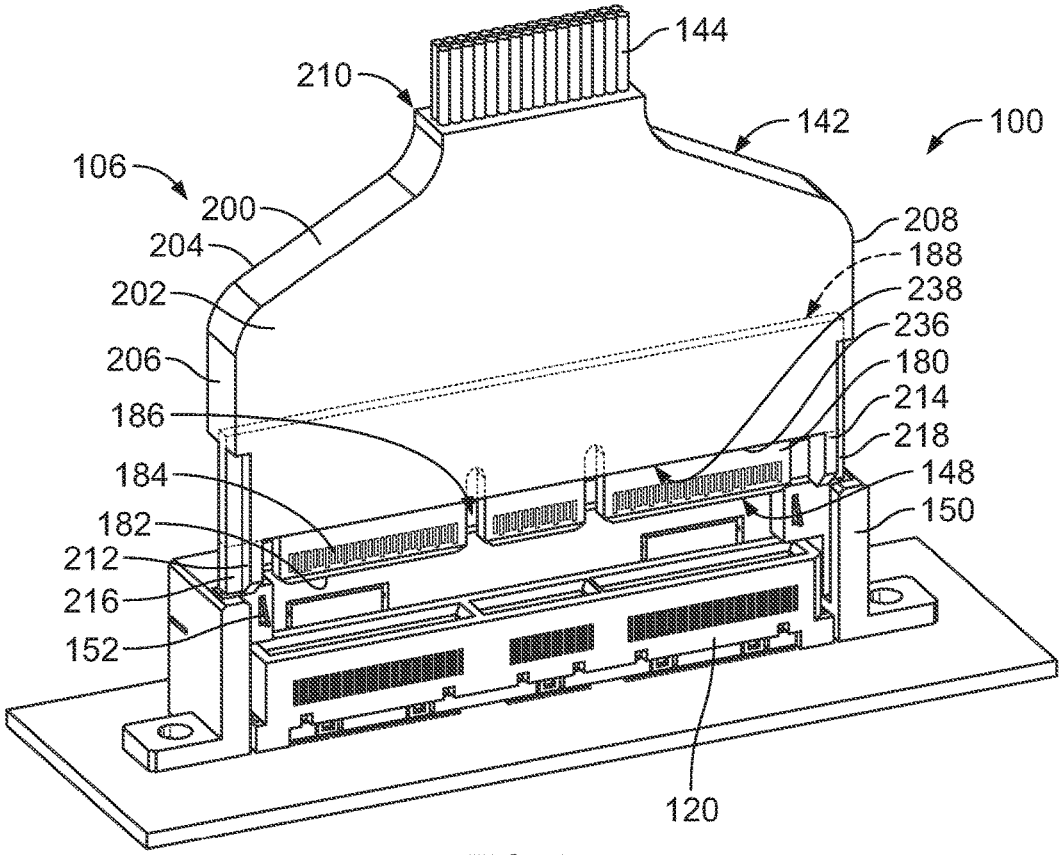
FIG. 4 is a perspective view of the card edge connector assembly showing the card edge connector, the support hardware and the pluggable module in accordance with an exemplary embodiment.
Figure 5:
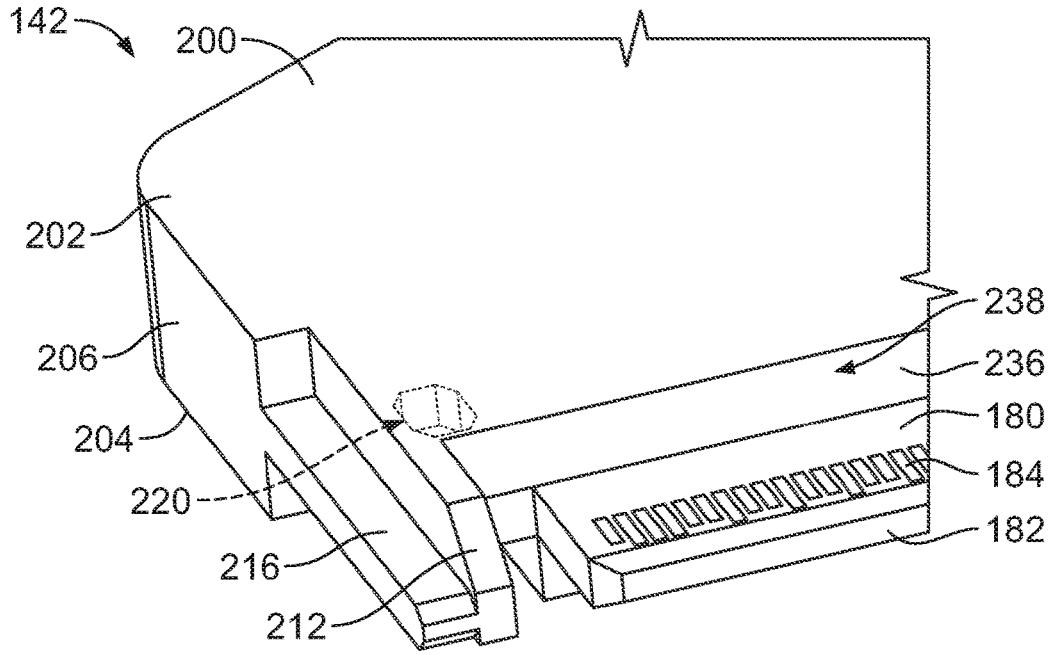
FIG. 5 is a front perspective view of a portion of the pluggable module in accordance with an exemplary embodiment.
Figure 6:
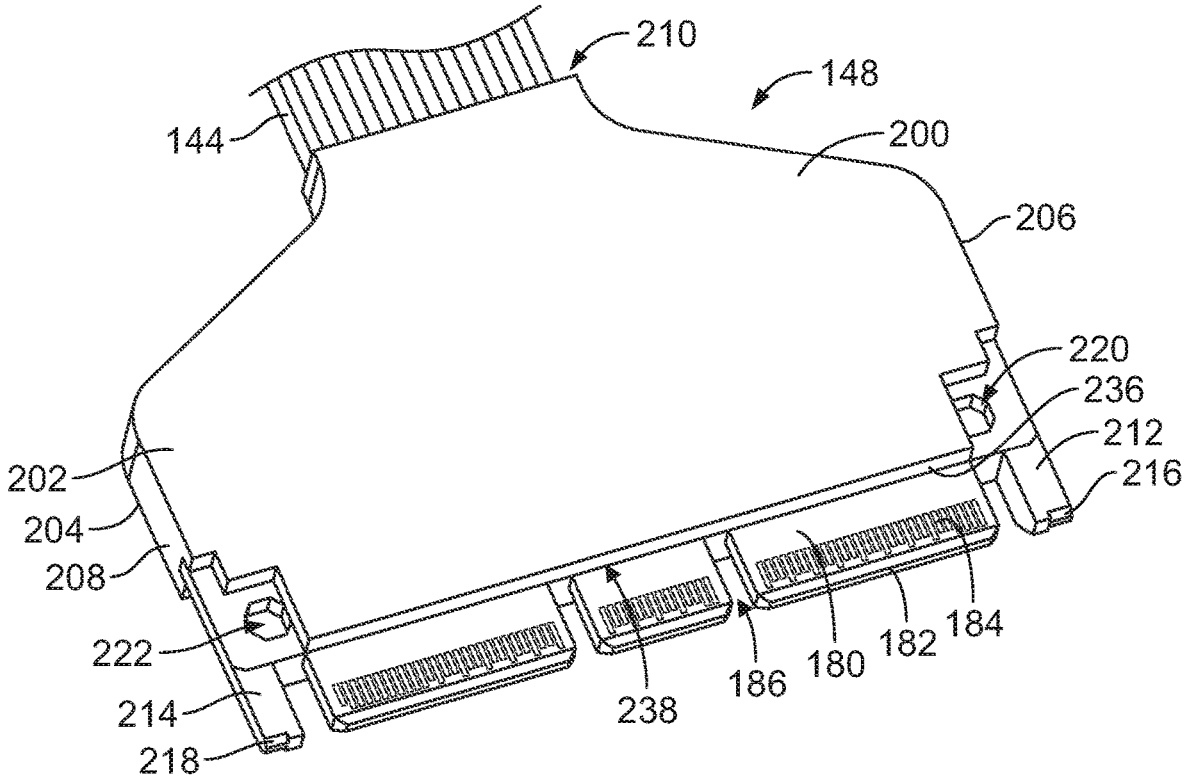
FIG. 6 is a rear perspective view of the pluggable module in accordance with an exemplary embodiment.

FIG. 4 is a perspective view of the card edge connector assembly 106 showing the card edge connector 120, the support hardware 150 and the cabled pluggable module 142 in accordance with an exemplary embodiment. FIG. 5 is a front perspective view of a portion of the cabled pluggable module 142 in accordance with an exemplary embodiment. FIG. 6 is a rear perspective view of the cabled pluggable module 142 in accordance with an exemplary embodiment.

The cabled pluggable module 142 includes the cables 144 to electrically connect the pluggable module 142 to another component remote from the pluggable module 142 within the electrical system 100. The pluggable module 142 interfaces with the cables 144 and with the corresponding card edge connector 120 (or the card edge connector 130 shown in FIGS. 1 and 2) to electrically connect the card edge connector 120 with another component, such as another connector, through the cables 144.

The pluggable module 142 includes a paddle card 180 having a card edge 182 at the mating end 148 configured to be loaded into the card edge connector 120. The paddle card 180 has a plurality of contact pads 184 at the card edge 182 configured to be electrically connected to the card edge connector 120. In an exemplary embodiment, the paddle card 180 includes one or more alignment slots 186 in the card edge 182 for locating the paddle card 180 within the card edge connector 120.

The cables 144 are terminated to a cable end 188 of the paddle card 180 generally opposite the mating end 148. For example, the cables 144 may be soldered to the paddle card 180. The paddle card 180 includes various circuits transmitting data and/or power between the contact pads 184 and the cables 144. In various embodiments, the pluggable module 142 does not include separate electrical components (for example, memory, processors, and the like) on the paddle card 180, but rather is electrically connected to corresponding electrical components via the cables 144. In other various embodiments, the paddle card 180 may include electrical components thereon.

The pluggable module 142 includes a pluggable body 200 configured to hold the paddle card 180 and/or the cables 144. For example, the pluggable body 200 may be an overmolded body molded around the cable end 188 of the paddle card 180 and ends of the cables 144. In other various embodiments, the pluggable body 200 is a housing, pre-molded and receiving the paddle card 180 and the ends of the cables 144. Optionally, the housing may be a multi-piece housing, such as two pieces coupled together around the paddle card 180 and the cables 144. The pluggable body 200 provides strain relief for the cables 144. In an exemplary embodiment, the card edge 182 of the paddle card 180 is exposed beyond an end of the pluggable body 200.

In an exemplary embodiment, the pluggable body 200 includes a first side 202 and a second side 204 extending between a first end 206 and a second end 208. The pluggable body 200 extends between the mating end 148 and a cable end 210 opposite the mating end 148. The cable end 210 may be truncated or narrower than the mating end 148. The cables 144 exit the pluggable body 200 at the cable end 210. In an exemplary embodiment, the pluggable body 200 includes a first mounting arm 212 at the first end 206 and a second mounting arm 214 at the second end 208. The mounting arms 212, 214 are used for mounting the pluggable module 142 to the support hardware 150. For example, the mounting arms 212, 214 may include ribs 216, 218, respectively, that are received in slots or tracks in the support hardware 150. In an exemplary embodiment, the ribs 216, 218 have the same thickness as the card edge 182 of the paddle card 180 to simulate the paddle card 170 (shown in FIG. 3) so that the support hardware 150 is able to receive both the ribs and the paddle card 170.

In an exemplary embodiment, the pluggable module 142 includes first and second latching features 220, 222 (FIG. 6) at the first and second ends 206, 208, respectively. The latching features 220, 222 interact with the latch 152 to latchably secure the pluggable module 142 in the support hardware 150.

In an exemplary embodiment, the pluggable body 200 includes a front edge 236 at the mating end 148. The card edge 182 of the paddle card 180 extends forward of the front edge 236. In an exemplary embodiment, the mounting arms 212, 214 extend forward of the front edge 236 along opposite ends of the paddle card 180. The pluggable body 200 includes one or more front stop surfaces 238, such as at the front edge 236. The front stop surfaces 238 are configured to engage the card edge connector 120 when the pluggable module 122 is mated thereto. The front stop surfaces 238 may rest against the support hardware 150 and/or the card edge connector 120.

Figure 7:
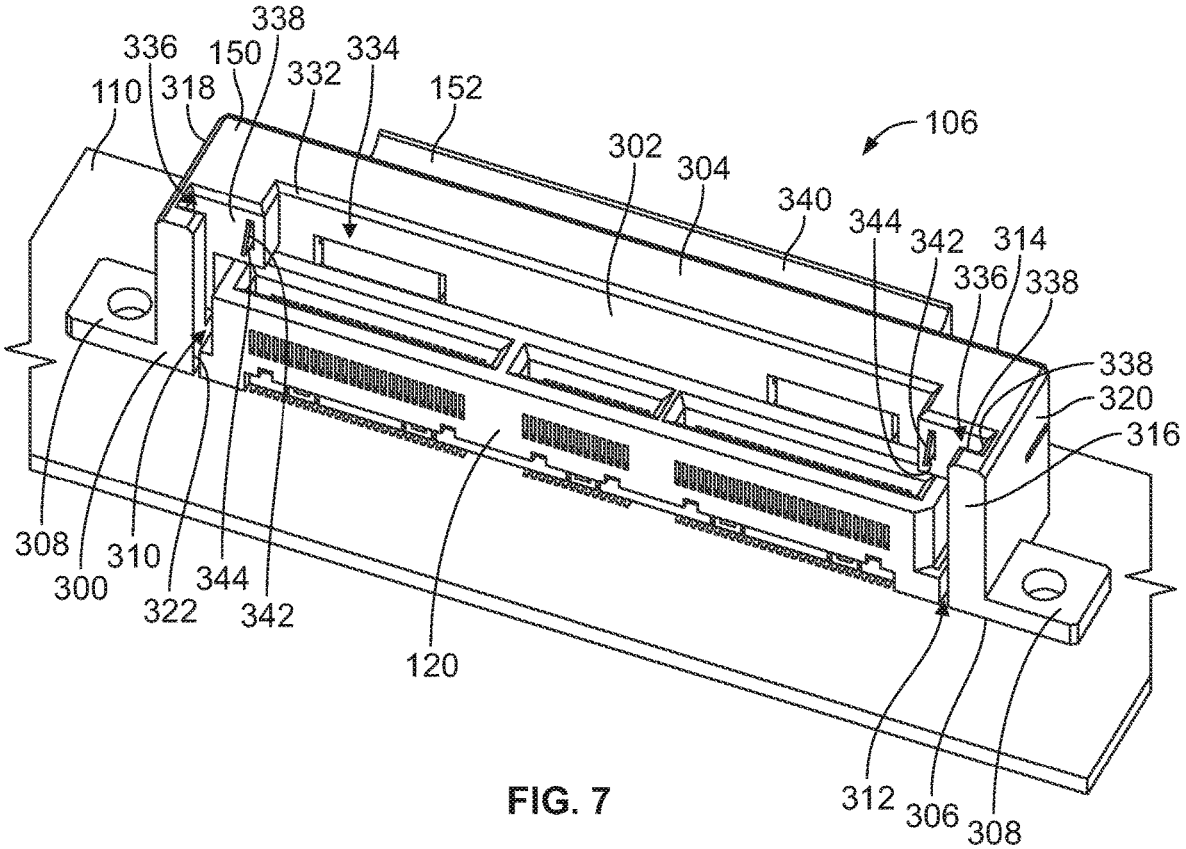
FIG. 7 is a front perspective view of a portion of the card edge connector assembly in accordance with an exemplary embodiment showing the card edge connector and the support hardware.
Figure 8:
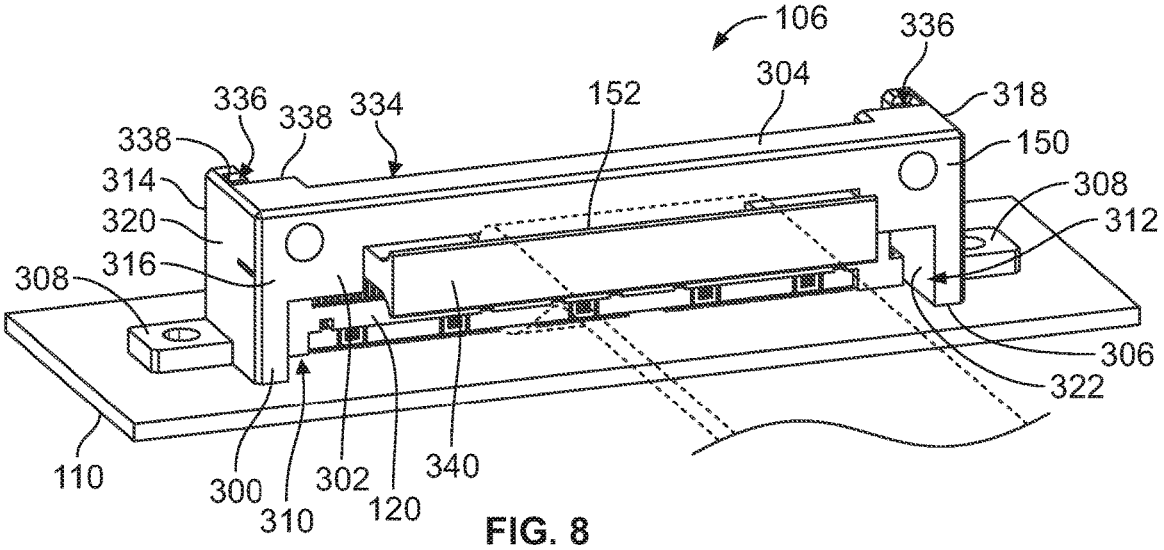
FIG. 8 is a rear perspective view of the support hardware in accordance with an exemplary embodiment.

FIG. 7 is a front perspective view of a portion of the card edge connector assembly 106 in accordance with an exemplary embodiment showing the card edge connector 120 and the support hardware 150 (the card edge connector 120 and the support hardware 150 may be used as part of the card edge connector assembly 102 in various embodiments). FIG. 8 is a rear perspective view of the support hardware 150 in accordance with an exemplary embodiment. Optionally, the support hardware 150 may be similar to the support hardware 160 (shown in FIGS. 1 and 2) and thus features of the support hardware 160 may be described herein with reference to the support hardware 150. For example, in an exemplary embodiment, the support hardware 150, 160 are configured to be mounted 90° relative to each other on the host circuit board 110 and thus have mounting features for mounting to the host circuit board that are oriented 90° relative to each other; however, the positioning of the support hardware 150, 160 relative to the circuit card connectors 120, 130 may be similar and the mating with the pluggable modules 122, 142 may be similar. As such, similar molds may be used for manufacturing the support hardware 150 and 160 to reduce design and manufacturing costs.

The support hardware 150 includes a base 300 at a bottom of the support hardware 150 configured to be mounted to the host circuit board 110 (shown in FIGS. 1 and 2) and a support beam 302 above the base 300. The base 300 is the portion of the support hardware 150 surrounding the circuit card connector 120 and the support beam 302 is the portion of the support hardware 150 above the circuit card connector 120 that supports the pluggable module 122 or 142. In an exemplary embodiment, the support hardware 150 is vertical support hardware configured to extend vertically (for example, perpendicular to the host circuit board 110) and be coupled to the pluggable module 122 or 142 in a vertical mating direction. The support beam 302 extends to a distal end or top 304 of the support hardware 150. The top 304 is generally opposite a bottom 306 of the support hardware 150 at the base 300, which is configured to be mounted to the host circuit board 110. In an exemplary embodiment, the bottom 306 includes a mounting feature 308 for mounting the base 300 to the host circuit board 110. In the illustrated embodiment, the mounting feature 308 is a threaded opening configured to receive mounting hardware, such as a fastener, such as a threaded screw. Other types of mounting features may be provided in alternative embodiments, such as a non-threaded opening, a post, a barb, a solder feature, and the like.

The base 300 includes a cavity 310 configured to receive the card edge connector 120 and one or more openings 312 providing access to the cavity 310. In an exemplary embodiment, the support hardware 150 includes opposite first and second sides 314, 316 extending between ends 318, 320 and between the top 304 and the bottom 306. In the illustrated embodiment, openings 312 are provided at the first and second sides 314, 316. The card edge connector 120 is exposed at the first side 314. The second side 316 may cover at least part of the opposite side of the card edge connector 120 and ties the ends 318, 320 together. In an exemplary embodiment, the support hardware 150 is generally box-shaped; however, the support hardware 150 may have other shapes in alternative embodiments including other portions. The support hardware 150 has a footprint defined by the bottom 306 between the ends 318, 320 and the sides 314, 316 configured to occupy a space above the host circuit board 110.

The base 300 includes one or more locating surfaces 322 configured to locate the support hardware 150 relative to the card edge connector 120. In an exemplary embodiment, the locating surfaces 322 are provided in the cavity 310 at the ends 318, 320 and at the second side 316 to locate the support hardware 150 relative to the card edge connector 120 in two directions. The locating surfaces 322 are configured to engage the card edge connector 120 to register the location of the support hardware 150 relative to the card edge connector 120. The locating surfaces 322 may guide side-to-side positioning of the support hardware 150 and end-to-end positioning of the support hardware 150 relative to the card edge connector 120.

The support beam 302 extends between the opposite ends 318, 320 of the support hardware 150. The support beam 302 is used to guide mating of the pluggable module 122 or 142 to the support hardware 150. The support beam 302 supports the pluggable module 122 or 142 to alleviate stresses and strains on the card edge connector 120, such as from pulling on the cables 144 of the pluggable module 142 by transferring the stresses and strains to the base 300 and the host circuit board 110. In an exemplary embodiment, the support beam 302 includes a lead-in 332 for guiding the pluggable module 122 or 142 during mating.

In an exemplary embodiment, the support beam 302 includes a pocket 334 configured to receive the pluggable module 122 or 142. The pocket 334 is located above the cavity 310 and above the card edge connector 120. Optionally, the pocket 334 is open at the first side 314 and enclosed by the body of the support beam 302 at the second side 316. In an exemplary embodiment, the support beam 302 includes guide channels 336 at the ends 318, 320 that receive portions of the pluggable module 122 or 142. The guide channels 336 may guide and position the pluggable module 122 or 142 in the pocket 334, such as for mating with the card edge connector 120. The support beam 302 around the guide channels 336 may support the pluggable module 122 or 142, such as by providing support surfaces 338 to support the pluggable module 122 or 142.

The latch 152 is coupled to the support beam 302, such as at the second side 316 and extends into the pocket 334 for interfacing with the pluggable module 122 or 142 when received therein. The latch 152 includes a latch handle 340 for actuating the latch 152. In the illustrated embodiment, the latch handle 340 is at the second side 316. The latch handle 340 may be grasped by the operator to release the latch 152, such as in a pulling direction away from the second side 316. In other embodiments, the latch handle 340 may be coupled to a tether (a portion is shown in phantom in FIG. 8) that may be pulled to release the latch 152. The latch 152 includes latching fingers 342 for latchably engaging the pluggable module 122 or 142. The latching fingers 342 extend into the pocket 334 to directly engage the pluggable module 122 or 142. Optionally, the latching fingers 342 may be wedge shaped to passively deflect the latching fingers 342 as the pluggable module 122 or 142 is loaded into the support hardware 150. The latching fingers 342 include latching surfaces 344 configured to engage and latchably couple to the pluggable module 122 or 142 to resist removal of the pluggable module 122 or 142 from the pocket 334. Other types of latching features may be provided in alternative embodiments. The latching features may be located at a different position on the support beam 302 or may be located on the base 300 in alternative embodiments.

Figure 9:
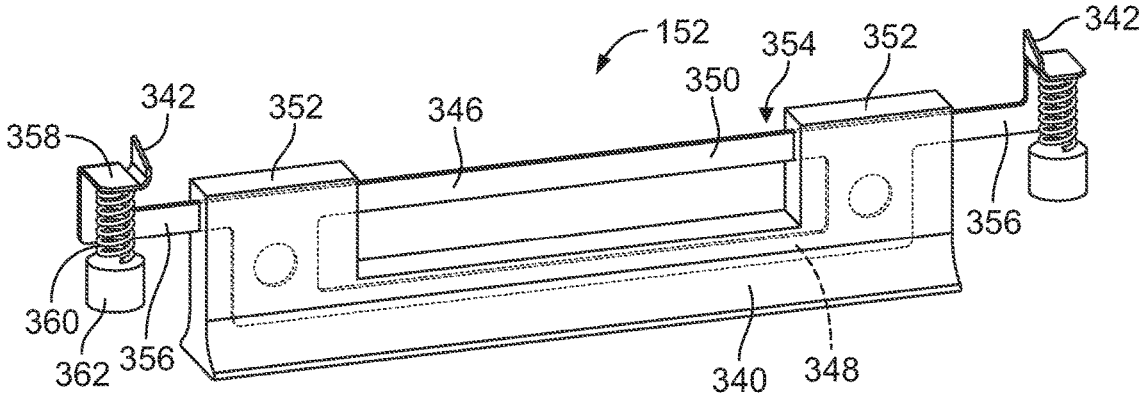
FIG. 9 is a perspective view of a latch for the support hardware in accordance with an exemplary embodiment.

FIG. 9 is a perspective view of the latch 152 in accordance with an exemplary embodiment. The latch 152 includes the latch handle 340 and a latch tab 346 coupled to the latch handle 340. Optionally, the latch tab 346 may be embedded in the latch handle 340. For example, the latch handle 340 may be overmolded on the latch tab 346. In an exemplary embodiment, the latch tab 346 is a stamped and formed latch tab stamped from a sheet metal plate and then formed to a predefined shape; however, the latch tab 346 may be manufactured from other processes and/or materials in alternative embodiments. The latch tab 346 includes embedded portions 348 in the latch handle 340. The latch tab 346 includes a mounting beam 350 between tabs 352 of the latch handle 340. The tabs 352 are provided at opposite ends of an opening 354. The mounting beam 350 is used for mounting the latch tab 346 in the support hardware 150. The latch tab 346 includes latching arms 356 at opposite ends of the latch 152. The latching fingers 342 are provided at distal ends of the latching arms 356. The latching fingers 342 may be bent out of plane from the latching arms 356. Optionally, the latching arms 356 may include biasing plates 358.

Biasing members 360 engage the biasing plates 358 to force the latch 152 forward in a biasing direction, such as to return the latch 152 to a latched position. Plugs 362, which are configured to be coupled to the support hardware 150, may be used to hold the biasing members 360. The biasing members 360 may be compressed between the plugs 362 and the biasing plates 358 when the latch 152 is pulled to the released position. In the illustrated embodiment, the biasing members 360 are coil springs; however, other types of biasing members 360 may be used in alternative embodiments. Optionally, the biasing members 360 may be integral with the latch tab 346, such as stamped and formed from the latch tab 346 in the form of cantilevered beams or other types of biasing members 360.

Figure 10:
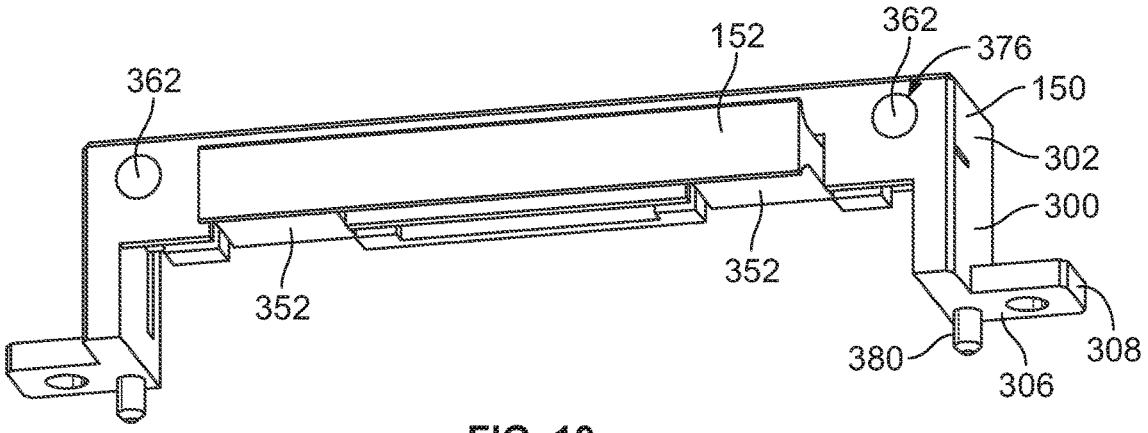
FIG. 10 is a perspective view of the support hardware and the latch in accordance with an exemplary embodiment.
Figure 11:
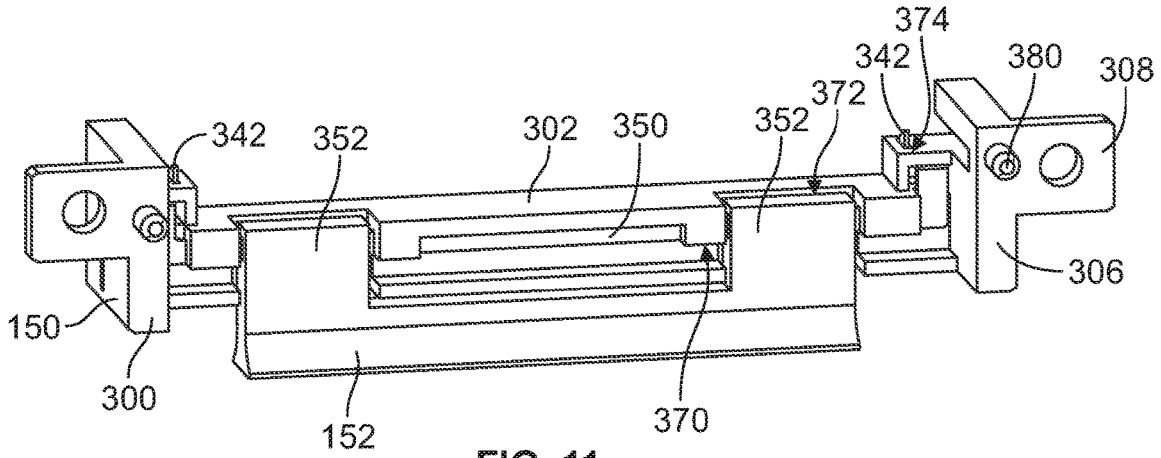
FIG. 11 is a bottom perspective view of the support hardware and the latch in accordance with an exemplary embodiment.

FIG. 10 is a perspective view of the support hardware 150 and the latch 152 in accordance with an exemplary embodiment. FIG. 11 is a bottom perspective view of the support hardware 150 and the latch 152 in accordance with an exemplary embodiment. The latch 152 is coupled to the support beam 302 of the support hardware 150. For example, the support beam 302 includes a channel 370 at the bottom of the support beam 302 that receives the mounting beam 350 and pockets 372 that receive the tabs 352. The support beam 302 includes openings 374 that receive the latching fingers 342 and openings 376 that receive the plugs 362. The latch 152 is movably coupled to the support beam 302. For example, the latch 152 may be pulled rearward to release the latch 152. The mounting beam 350 may slide rearward in the channel 370 and the tabs 352 may slide rearward in the pockets 372.

In an exemplary embodiment, the support hardware 150 includes locating posts 380 at the bottom 306 extending from the base 300. The locating posts 380 may be located proximate to the mounting features 308. The locating posts 380 are configured to be received in the host circuit board 110 (shown in FIGS. 1 and 2) to locate the support hardware 150 relative to the host circuit board 110. Other types of locating features may be used in alternative embodiments.

Figure 12:
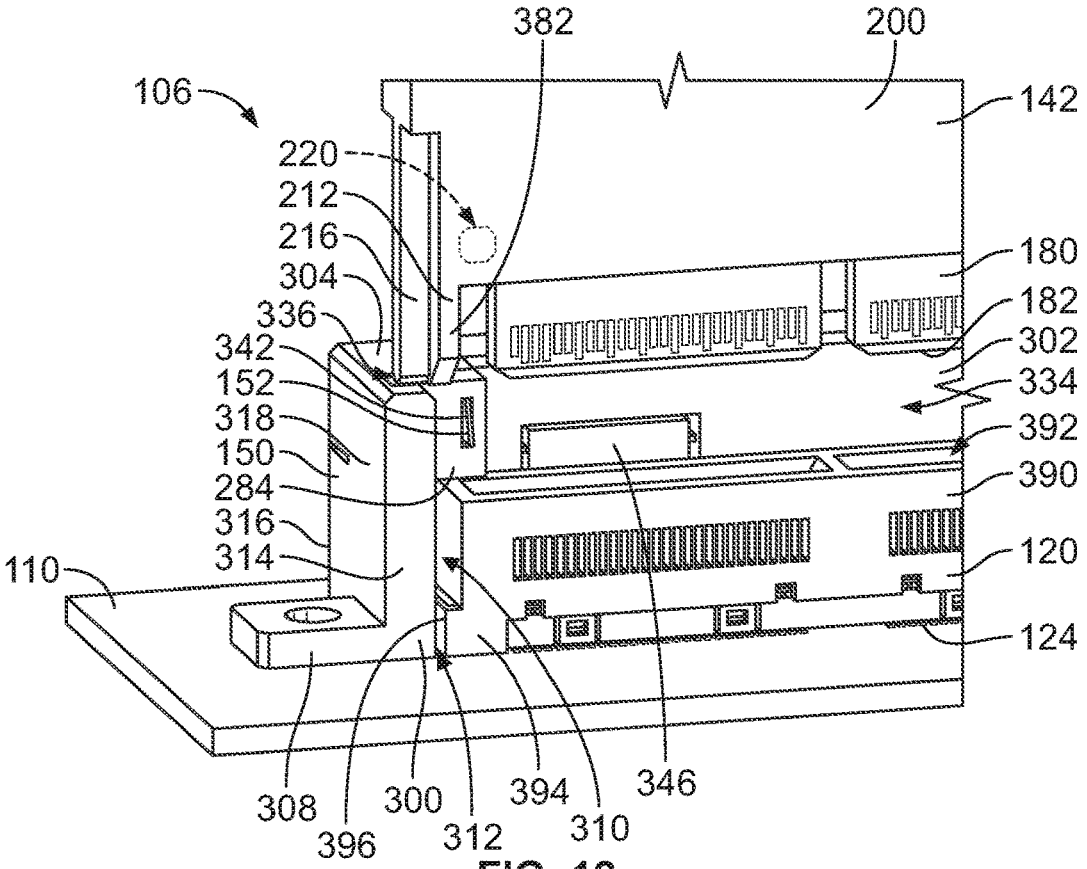
FIG. 12 is a front perspective view of a portion of the card edge connector assembly in accordance with an exemplary embodiment showing the pluggable module poised for coupling with the circuit card connector and the support hardware.
Figure 13:
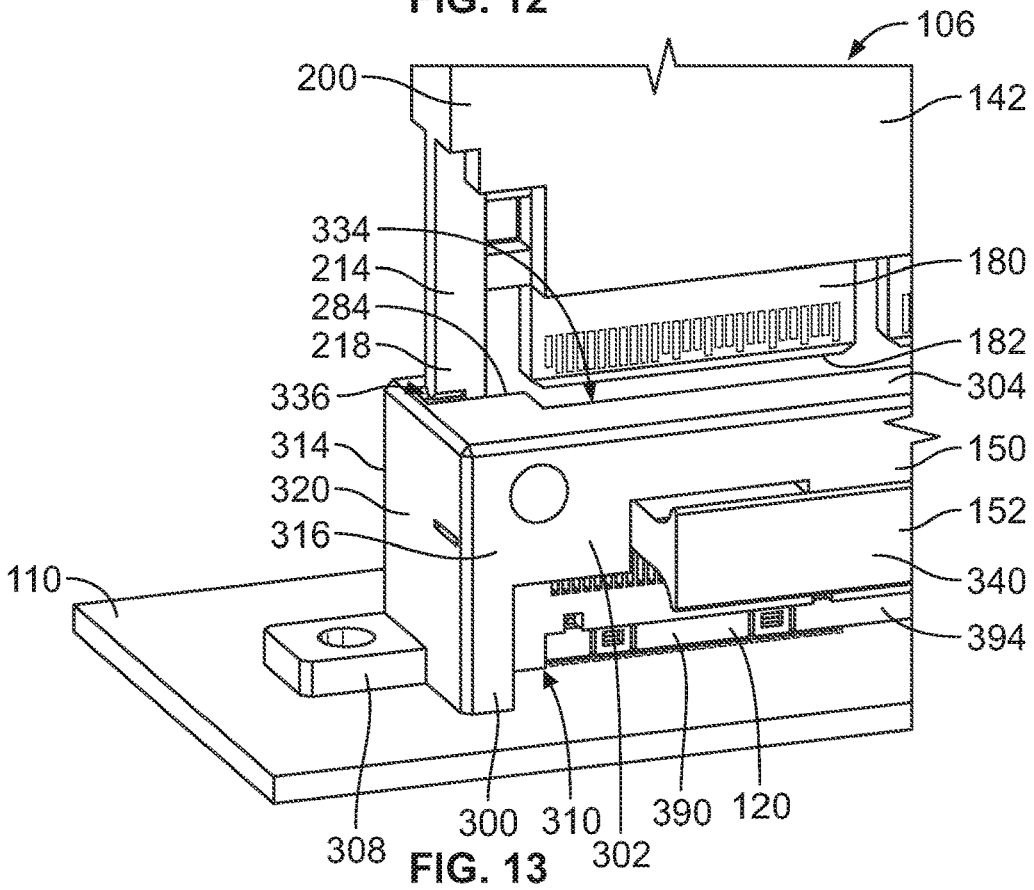
FIG. 13 is a rear perspective view of a portion of the card edge connector assembly in accordance with an exemplary embodiment showing the pluggable module poised for coupling with the circuit card connector and the support hardware.

FIG. 12 is a front perspective view of a portion of the card edge connector assembly 106 in accordance with an exemplary embodiment showing the pluggable module 142 poised for coupling with the circuit card connector 120 and the support hardware 150. FIG. 13 is a rear perspective view of a portion of the card edge connector assembly 106 in accordance with an exemplary embodiment showing the pluggable module 142 poised for coupling with the circuit card connector 120 and the support hardware 150.

The card edge connector 120 includes a housing 390 having a card slot 392 configured to receive the paddle card 180 of the pluggable module 142. In an exemplary embodiment, the card slot 392 is configured to receive the paddle card 170 (shown in FIG. 3) of the pluggable module 122 (shown in FIG. 3). The housing 390 has a base 394 configured to be mounted to the host circuit board 110. The base 394 includes a locating surface 396 engaging the locating surface 322 of the support hardware 150 to register the location of the support hardware 150 to the housing 390. The housing 390 holds the contacts 124 in the card slot 392 to electrically connect to the paddle card 180.

The pluggable module 142 is positioned above the pocket 334 and the cavity 310 and lowered into the pocket 334 for mating with the circuit card connector 120. The mounting arms 212, 214 of the pluggable body 200 are aligned with the guide channels 336 at the ends 318, 320 of the support beam 302. The ribs 216, 218 are configured to be received in the guide channels 336. In an exemplary embodiment, the mounting arms 212, 214 include keying features 382 to key mating of the pluggable module 142 with the support hardware 150. For example, the keying features 382 may extend from one side of the pluggable body 200, such as proximate to the ribs 216, 218. The support hardware 150 includes blocking surfaces 284 that interfere with the keying features 382 if the pluggable module 142 is attempted to be loaded in the wrong direction (for example, 180 degrees). In the illustrated embodiment, the keying features 382 are received in the opening 312 at the first side 314. Other types of keying features may be provided in alternative embodiments.

During mating, the pluggable module 142 is loaded into the pocket 334 through the open top 304. The mounting arms 212, 214 are received in the pocket 334 with the ribs 216, 218 received in the guide channels 336. The mounting arms 212, 214 engage the support beam 302 to locate the paddle card 180 relative to the card edge connector 120. The card edge 182 of the paddle card 180 is aligned with and received in the card slot of the card edge connector 120. As the pluggable module 142 is loaded into the pocket 334, the pluggable module 142 deflects the latching fingers 342 outward to allow the pluggable module 142 to fully load into the card edge connector 120. When fully mated, the latching fingers 342 spring back to a latched position and are latchably coupled to the pluggable module 142. For example, the latching fingers 342 are received in latching features 220 (shown in phantom in FIG. 12), 222 (FIG. 13). The latching features 220, 222 include latching surfaces 390 configured to engage the latching fingers 342. In the illustrated embodiment, the latching features 220, 222 are openings in the paddle cared 180; however, the latching features 220, 222 may be openings in the pluggable body 200 rather than the paddle card 180. In other alternative embodiments, other types of latching features may be provided for latchably coupling to the latching fingers 342.

In an exemplary embodiment, the card edge connector 120 is able to be coupled to either the pluggable module 142 or the pluggable module 122 (shown in FIG. 3). For example, the card edge connector 120 and the support hardware 150 have a mating interface that interfaces with either of the pluggable modules 122, 142. Because the cabled pluggable module 142 tends to move around, such as when the cables 144 are manipulated or pulled, the support hardware 150 provides additional support to ensure that the card edge connector 120 is not damaged. Excessive movement of the card edge connector 120 may cause the contacts 124 to separate from the host circuit board 110. For example, the solder between the contacts 124 and the host circuit board 110 may break causing electrical shorts. The support hardware 150 is coupled to the card edge connector 120 and the host circuit board 110 to alleviate stresses and strains on the card edge connector 120. For example, the cabled pluggable module 142 is mounted to the support beam 302 and movement of the cabled pluggable module 142 is transferred from the support beam 302 to the base 300 and to the host circuit board 110 through the fastener used to secure the mounting feature 308 to the host circuit board 110.

When assembled, the support hardware 150 registers the pluggable module 142 relative to the card edge connector 120 and supports the pluggable module 142 to hold the paddle card 180 relative to the contacts 124. The support hardware 150 is registered to the housing 390 of the card edge connector 120 by the locating surface 322 of the support hardware 150 engaging the locating surface 396 of the housing 390. The base 300 of the support hardware 150 is secured to the host circuit board 110 independent of the card edge connector 120.

In various embodiments, the latch 152 is arranged with the latch handle 340 at the first side 316 of the support hardware 150. The latch tab 346 is coupled to the latch handle 340 and positioned relative to the support hardware 150 such that the latching finger 342 is able to engage the pluggable module 142 to latchably secure the pluggable module 142 in the support hardware 150. For example, in various embodiments, the latching finger 342 extends into the pocket 334 to engage the pluggable module 142 to latchably secure the pluggable module 142 in the support hardware 150. The latching fingers 342 are configured to directly engage the paddle card 180 of the pluggable module 142 to latchably secure the pluggable module 142 in the support hardware 150. The latch 152 is actuated to retract the latching finger 342 out of the pocket 334 to remove the pluggable module 142 from the pocket 334. In various embodiments, the latch handle 340 has a tether 398 (FIG. 13) coupled thereto configured to pull the latch handle 340 and the latch tab 346 to release the pluggable module 142. The latch 152 may be pulled away from the support hardware 150 in a release direction perpendicular to a mating direction of the pluggable module 142 with the card edge connector 120. The biasing members 360 (shown in FIG. 9) bias the latch 152 to a latched position.

In various embodiments, the support beam 302 is positioned vertically above the base 300 to receive the pluggable module 142 in a mating direction perpendicular to the host circuit board 110. However, in alternative embodiments, the support beam 302 may extend from the base 300 generally parallel to the host circuit board 110, such as with the pocket 346 between the host circuit board 110 and the support beam 302. The support hardware 150 transfers forces from the pluggable module 142 to the host circuit board 110 independent of the card edge connector 120. In various embodiments, the pluggable body 200 has the ribs 216, 218 at the ends thereof that are received in the guide channels 336 in the pocket 334 of the support hardware 150 to position the pluggable module 142 in the pocket 334. The keying features 382 provide keyed mating of the pluggable module 142 with the support hardware 150.

Figure 14:
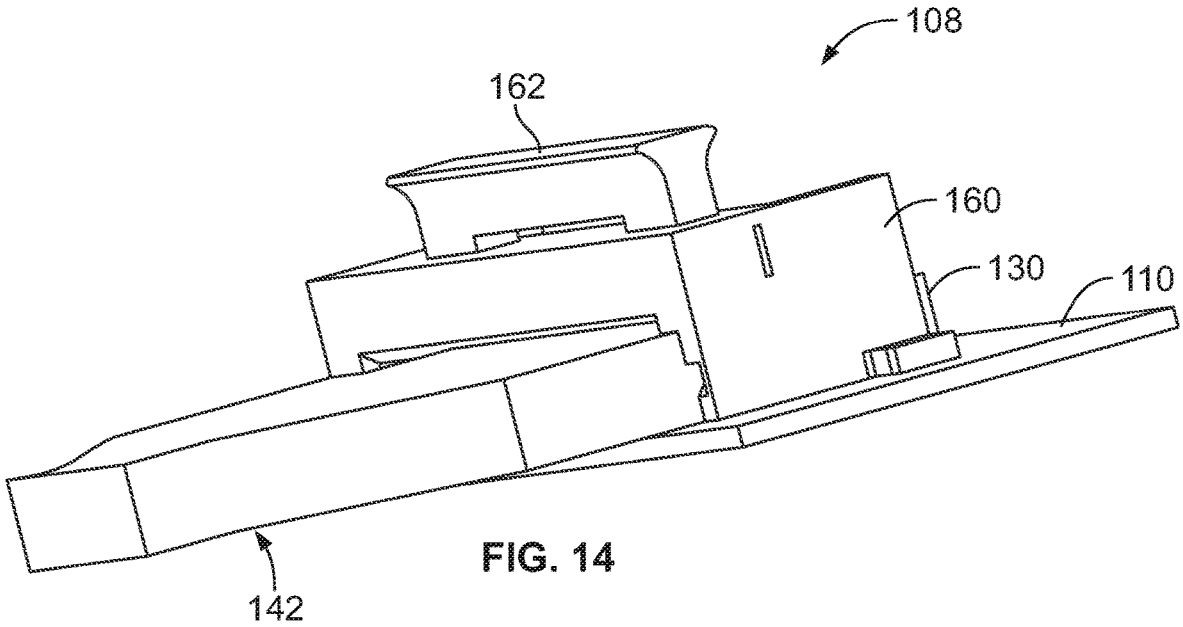
FIG. 14 is a perspective view of the card edge connector assembly showing the card edge connector, the support hardware and the pluggable module in accordance with an exemplary embodiment.
Figure 15:
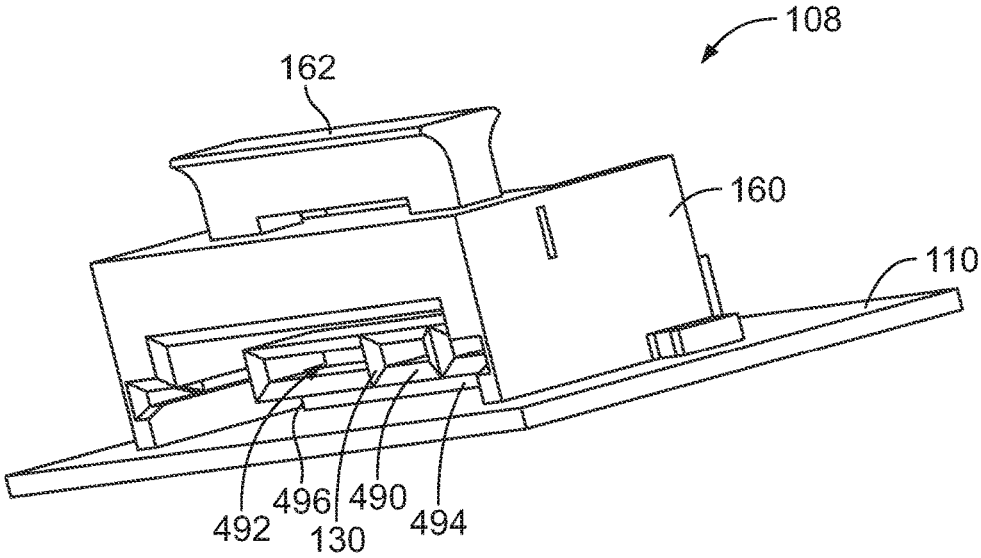
FIG. 15 is a perspective view of the card edge connector assembly showing the card edge connector and the support hardware in accordance with an exemplary embodiment.

FIG. 14 is a perspective view of the card edge connector assembly 108 showing the card edge connector 130, the support hardware 160 and the cabled pluggable module 142 in accordance with an exemplary embodiment. FIG. 15 is a perspective view of the card edge connector assembly 108 without the cabled pluggable module 142 showing the card edge connector 130 and the support hardware 160.

In an exemplary embodiment, the card edge connector 130 includes similar dimensions as the card edge connector 120 (shown in FIGS. 12 and 13); however, the card edge connector 130 is rotated 90° on its side for mating with the cabled pluggable module 142 in a mating direction generally parallel to the host circuit board 110 rather than the vertical or perpendicular mating direction of the card edge connector 120. The card edge connector 130 and the card edge connector 120 may have similar or identical mating interfaces for mating with the same cabled pluggable module 142 (or the non-cabled pluggable module 122). While the card edge connector 130 is similar to the card edge connector 120, the card edge connector 130 may include different mounting features for mounting to the host circuit board 110 and different contacts for electrical connection to the host circuit board 110; however, the mating interface may be similar or identical to the mating interface of the card edge connector 120.

The card edge connector 130 includes a housing 490 having a card slot 492 configured to receive the paddle card 180 of the pluggable module 142. In an exemplary embodiment, the card slot 492 is configured to receive the paddle card 170 (shown in FIG. 3) of the pluggable module 122 (shown in FIG. 3). The housing 490 has a base 494 configured to be mounted to the host circuit board 110. The base 494 includes a locating surface 496 to register the location of the support hardware 160 to the housing 490. The housing 490 holds the contacts 134 in the card slot 492 to electrically connect to the paddle card 180.

In an exemplary embodiment, the support hardware 160 include similar dimensions as the support hardware 150 (shown in FIGS. 12 and 13); however, the support hardware 160 is rotated 90° on its side for receiving the card edge connector 130 and for mating with the cabled pluggable module 142 in a mating direction generally parallel to the host circuit board 110 rather than the vertical or perpendicular mating direction of the support hardware 150. While the support hardware 160 is similar to the support hardware 150, the support hardware 160 may include different mounting features for mounting to the host circuit board 110. For example, the mounting features may be rotated approximately 90° compared to the mounting features of the support hardware 150. The support hardware 160 includes the latch 162 at the top configured to be pulled upward or in another pulling direction to release the latch 162. The latch 162 latchably secures the pluggable module 122 in the support hardware 160 and the card edge connector 130.

Figure 16:
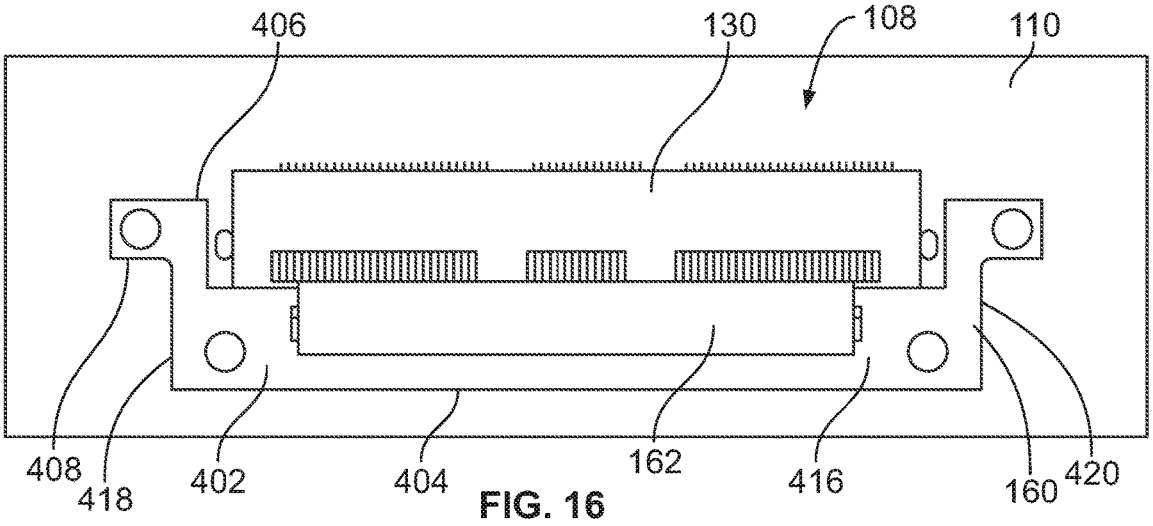
FIG. 16 is a top view of the card edge connector assembly in accordance with an exemplary embodiment showing the card edge connector and the support hardware.
Figure 17:
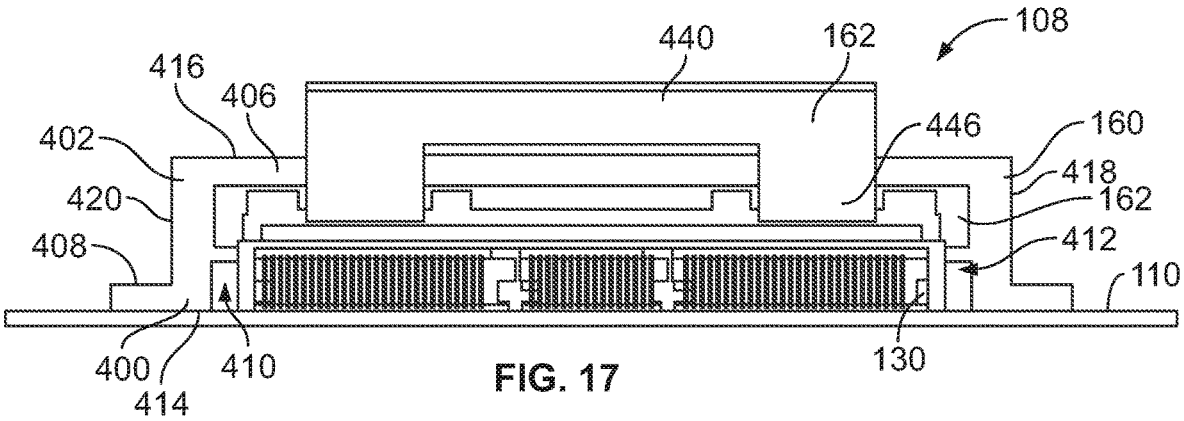
FIG. 17 is a front view of the card edge connector assembly in accordance with an exemplary embodiment.
Figure 18:
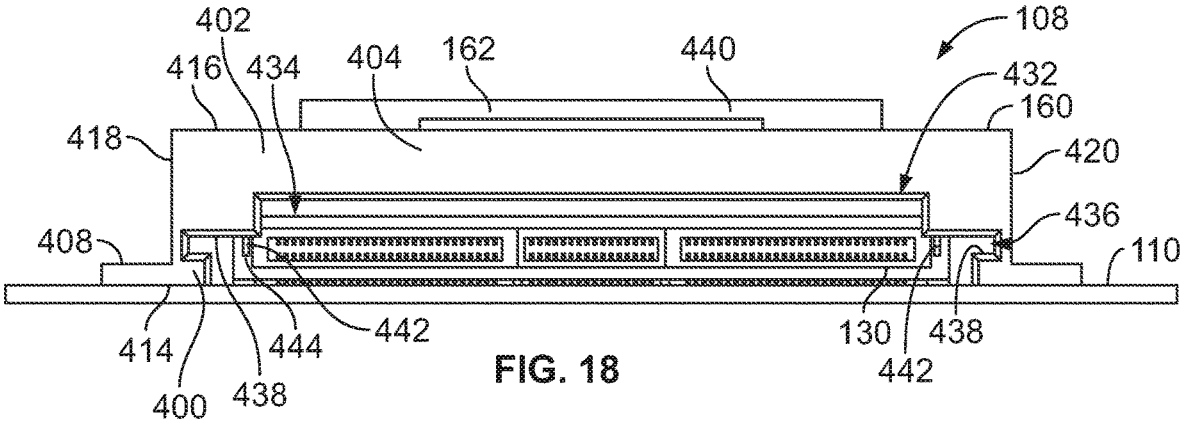
FIG. 18 is a rear view of the card edge connector assembly in accordance with an exemplary embodiment.
Figure 19:
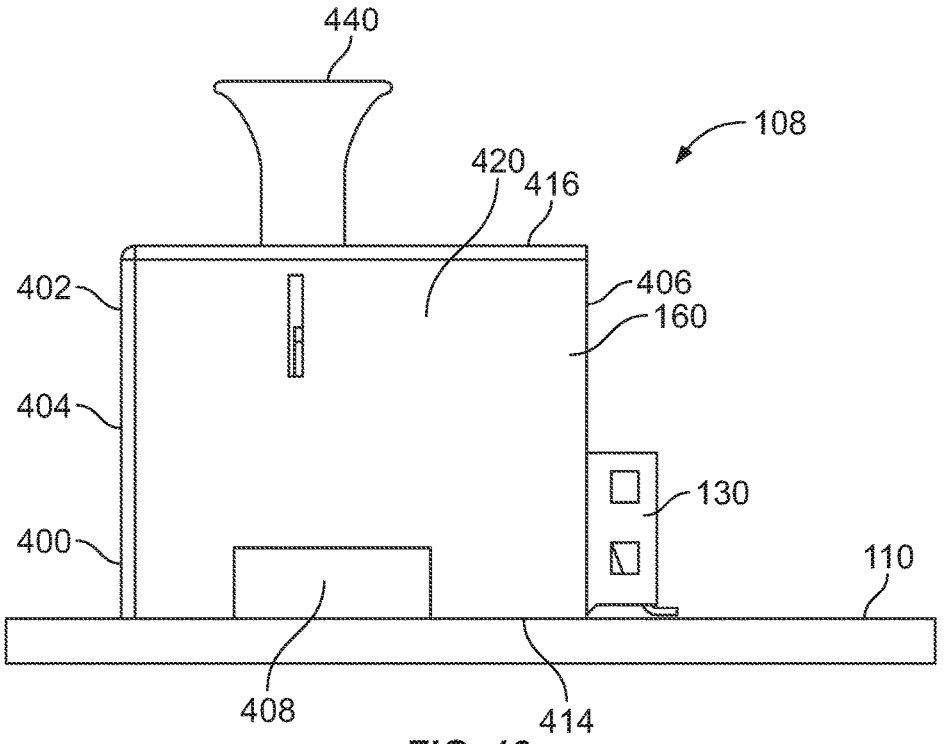
FIG. 19 is an end view of the card edge connector assembly in accordance with an exemplary embodiment.

FIG. 16 is a top view of the card edge connector assembly 108 in accordance with an exemplary embodiment showing the card edge connector 130 and the support hardware 160 (the card edge connector 130 and the support hardware 160 may be used as part of the card edge connector assembly 104 in various embodiments). FIG. 17 is a front view of the card edge connector assembly 108 in accordance with an exemplary embodiment. FIG. 18 is a rear view of the card edge connector assembly 108 in accordance with an exemplary embodiment. FIG. 19 is an end view of the card edge connector assembly 108 in accordance with an exemplary embodiment. The card edge connector assembly 108 is mounted to the host circuit board 110 and is configured to receive the pluggable module 122 or 142 (both shown in FIGS. 1 and 2) in a mating direction parallel to the host circuit board 110.

Optionally, the support hardware 160 may be similar to the support hardware 150 (shown in FIGS. 1 and 2) and thus features of the support hardware 150 may be described herein with reference to the support hardware 160. For example, in an exemplary embodiment, the support hardware 150, 160 are configured to be mounted 90° relative to each other on the host circuit board 110 and thus have mounting features for mounting to the host circuit board that are oriented 90° relative to each other; however, the positioning of the support hardware 150, 160 relative to the circuit card connectors 120, 130 may be similar and the mating with the pluggable modules 122, 142 may be similar. As such, similar molds may be used for manufacturing the support hardware 150 and 160 to reduce design and manufacturing costs.

Figure 20:
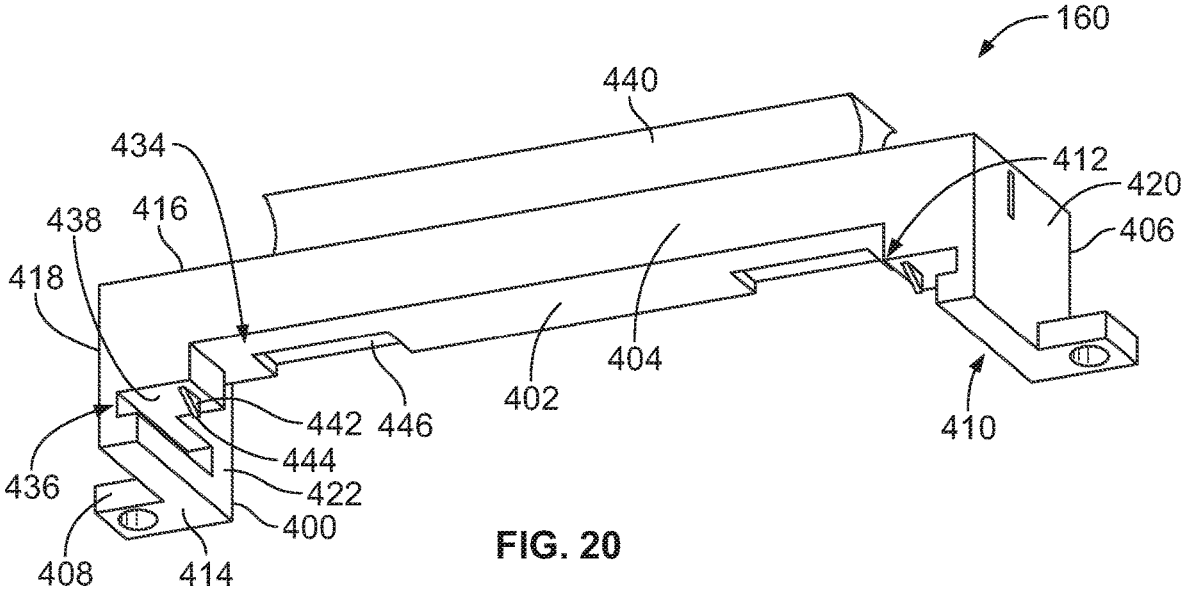
FIG. 20 is a front perspective view of the support hardware in accordance with an exemplary embodiment.
Figure 21:
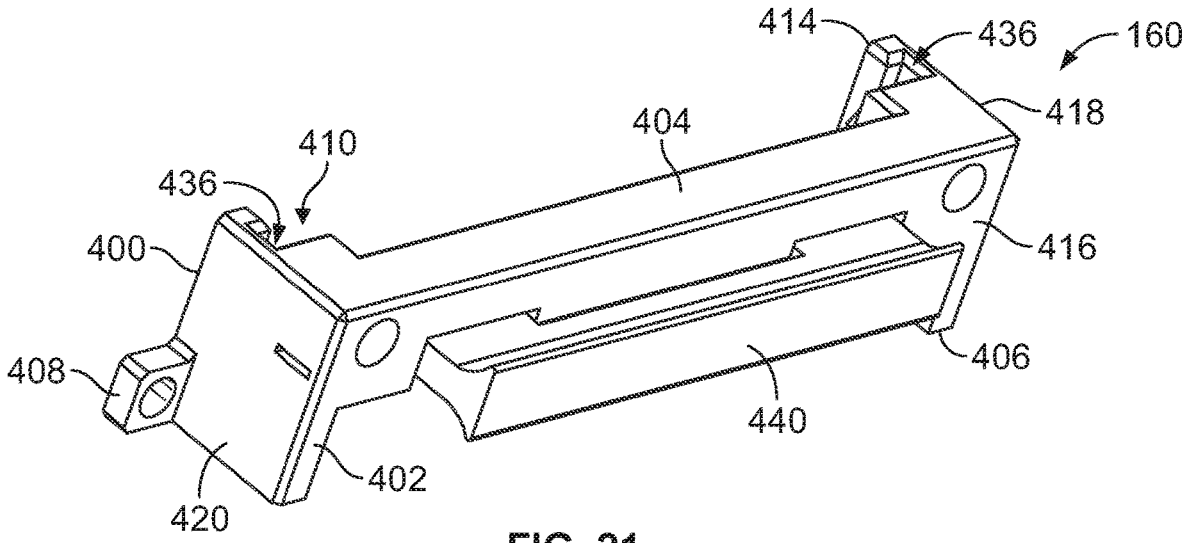
FIG. 21 is a top perspective view of the support hardware in accordance with an exemplary embodiment.
Figure 22:
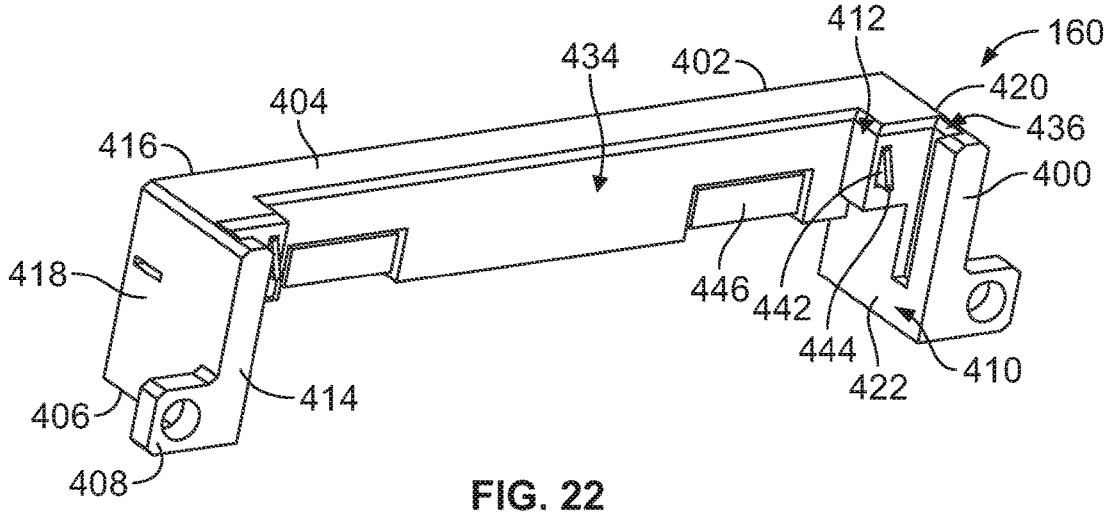
FIG. 22 is a bottom perspective view of the support hardware in accordance with an exemplary embodiment.
Figure 23:
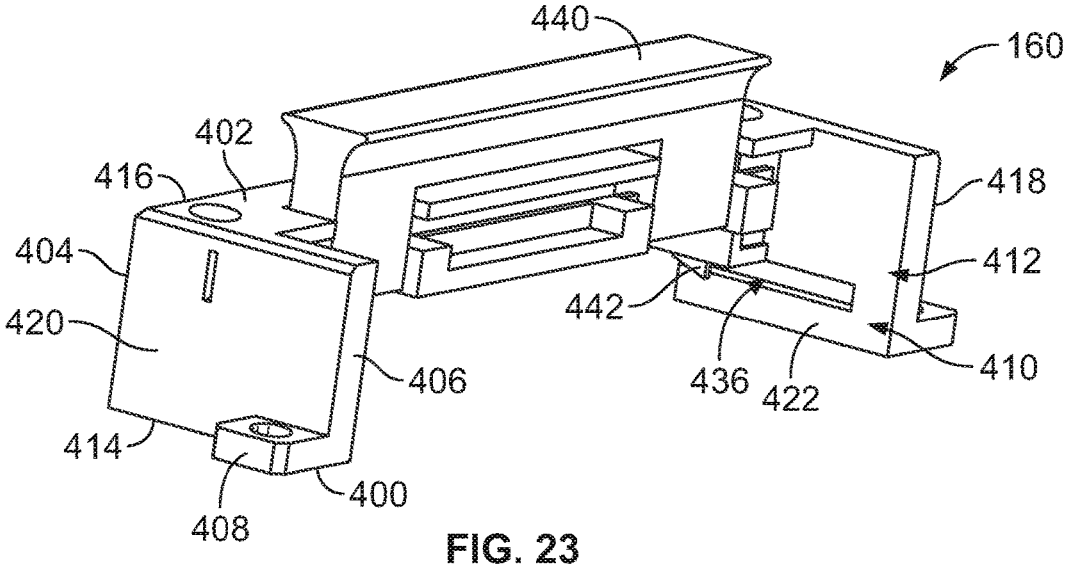
FIG. 23 is a rear perspective view of the support hardware in accordance with an exemplary embodiment.

With additional reference to FIGS. 20-23, FIGS. 20-23 show views of the support hardware 160. FIG. 20 is a front perspective view of the support hardware 160. FIG. 21 is a top perspective view of the support hardware 160. FIG. 22 is a bottom perspective view of the support hardware 160. FIG. 23 is a rear perspective view of the support hardware 160.

The support hardware 160 includes a base 400 at a back of the support hardware 160 configured to be mounted to the host circuit board 110 (shown in FIGS. 1 and 2) and a support beam 402 forward of the base 400. The base 400 is the portion of the support hardware 160 surrounding the circuit card connector 130 and the support beam 402 is the portion of the support hardware 160 forward of the circuit card connector 130 that supports the pluggable module 122 or 142. In an exemplary embodiment, the support hardware 160 is horizontal support hardware configured to extend horizontally (for example, parallel to the host circuit board 110) and be coupled to the pluggable module 122 or 142 in a horizontal mating direction. The support beam 402 extends to a distal end at a front 404 of the support hardware 160. The front 404 is generally opposite a rear 406 of the support hardware 160 at the base 400. The base 400 is configured to be mounted to the host circuit board 110 suing mounting features 408 at the rear 406 for mounting the base 400 to the host circuit board 110. In the illustrated embodiment, the mounting feature 408 is a threaded opening configured to receive mounting hardware, such as a fastener, such as a threaded screw. Other types of mounting features may be provided in alternative embodiments, such as a non-threaded opening, a post, a barb, a solder feature, and the like.

The base 400 includes a cavity 410 configured to receive the card edge connector 130 and one or more openings 412 providing access to the cavity 410. In an exemplary embodiment, the support hardware 160 includes opposite first and second sides 414, 416, which in the illustrated embodiment define a bottom side 414 and a top side 416 extending between ends 418, 420. The bottom side 414 rests on the host circuit board 110. In the illustrated embodiment, openings 412 are provided at the first and second sides 414, 416. The card edge connector 130 is exposed at the first side 414 for mounting to the host circuit board 110. The second side 416 may cover at least part of the opposite side of the card edge connector 130 and ties the ends 418, 420 together. In an exemplary embodiment, the support hardware 160 is generally box-shaped; however, the support hardware 160 may have other shapes in alternative embodiments including other portions. The support hardware 160 has a footprint defined by the bottom side 414 between the ends 418, 420 and between the front 404 and the rear 406 configured to occupy a space above the host circuit board 110.

The base 400 includes one or more locating surfaces 422 configured to locate the support hardware 160 relative to the card edge connector 130. In an exemplary embodiment, the locating surfaces 422 are provided in the cavity 410 at the ends 418, 420 and/or at the second side 416 to locate the support hardware 160 relative to the card edge connector 130 in two directions. The locating surfaces 422 are configured to engage the card edge connector 130 to register the location of the support hardware 160 relative to the card edge connector 130. The locating surfaces 422 may guide front-to-rear positioning of the support hardware 160 and end-to-end positioning of the support hardware 160 relative to the card edge connector 130.

The support beam 402 extends between the opposite ends 418, 420 of the support hardware 160. The support beam 402 is used to guide mating of the pluggable module 122 or 142 to the support hardware 160. The support beam 402 supports the pluggable module 122 or 142 to alleviate stresses and strains on the card edge connector 130, such as from pulling on the cables 144 of the pluggable module 142 by transferring the stresses and strains to the base 400 and the host circuit board 110. In an exemplary embodiment, the support beam 402 includes a lead-in 432.

In an exemplary embodiment, the support beam 402 includes a pocket 434 configured to receive the pluggable module 122 or 142. The pocket 434 is located forward of the cavity 410 and the card edge connector 130. Optionally, the pocket 434 is open at the first side 414 and enclosed by the body of the support beam 402 at the second side 416. In an exemplary embodiment, the support beam 402 includes guide channels 436 at the ends 418, 420 that receive portions of the pluggable module 122 or 142. The guide channels 436 may guide and position the pluggable module 122 or 142 in the pocket 434, such as for mating with the card edge connector 130. The support beam 402 around the guide channels 436 may support the pluggable module 122 or 142, such as by providing support surfaces 438 to support the pluggable module 122 or 142.

The latch 162 is coupled to the support beam 402, such as at the top side 416 and extends into the pocket 434 for interfacing with the pluggable module 122 or 142 when received therein. The latch 162 may be similar to or identical to the latch 152 (shown in FIG. 9). The latch 162 includes a latch handle 440 for actuating the latch 162 and a latch tab 446 coupled to the latch handle 440. The latch handle 440 may be grasped by the operator to release the latch 162, such as in a pulling direction away from the second side 416. In other embodiments, the latch handle 440 may be coupled to a tether that may be pulled to release the latch 162. The latch 162 includes latching fingers 442 for latchably engaging the pluggable module 122 or 142. The latching fingers 442 extend into the pocket 434 to directly engage the pluggable module 122 or 142. The latching fingers 442 include latching surfaces 444 configured to engage and latchably couple to the pluggable module 122 or 142 to resist removal of the pluggable module 122 or 142 from the pocket 434. Other types of latching features may be provided in alternative embodiments. The latching features may be located at a different position on the support beam 402 or may be located on the base 400 in alternative embodiments.

Figure 24:
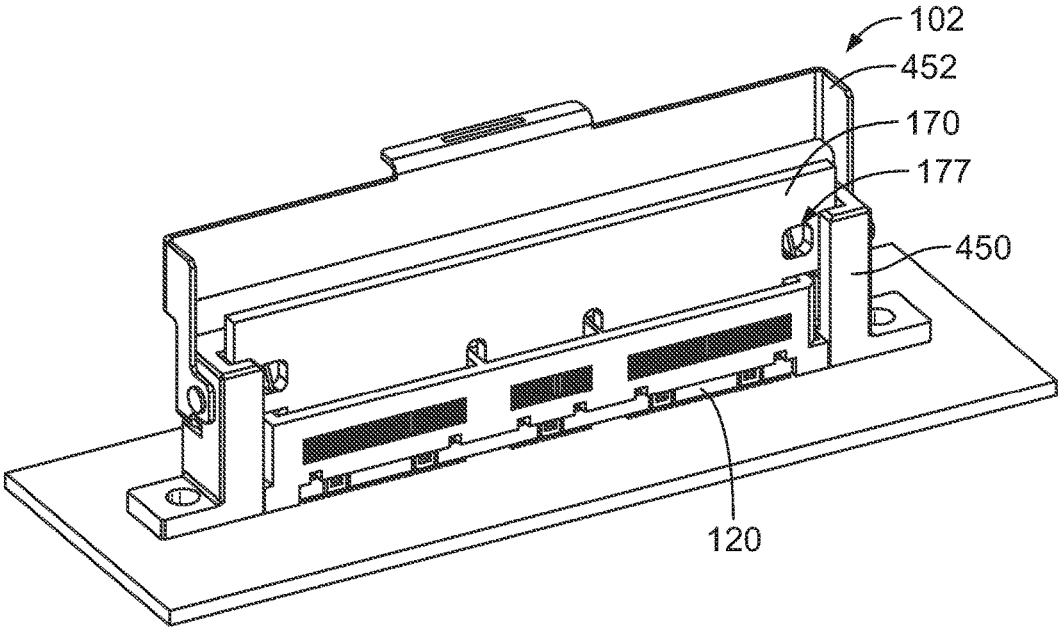
FIG. 24 is a perspective view of the card edge connector assembly showing the card edge connector, support hardware and the pluggable module in accordance with an exemplary embodiment.

FIG. 24 is a perspective view of the card edge connector assembly 102 showing the card edge connector 120, support hardware 450 and the non-cabled pluggable module 122 in accordance with an exemplary embodiment. The support hardware 450 illustrated in FIG. 24 differs from the support hardware 150 illustrated in FIGS. 1-13. The support hardware 450 includes a different type of latch 452 than the latch 152. The latch 452 is latchably secured to the non-cabled pluggable module 122 to secure the pluggable module 122 in the support hardware 450 and the card edge connector 120. For example, the latch 452 is configured to engage the latching features 177 of the paddle card 170 of the pluggable module 122.

Figure 25:
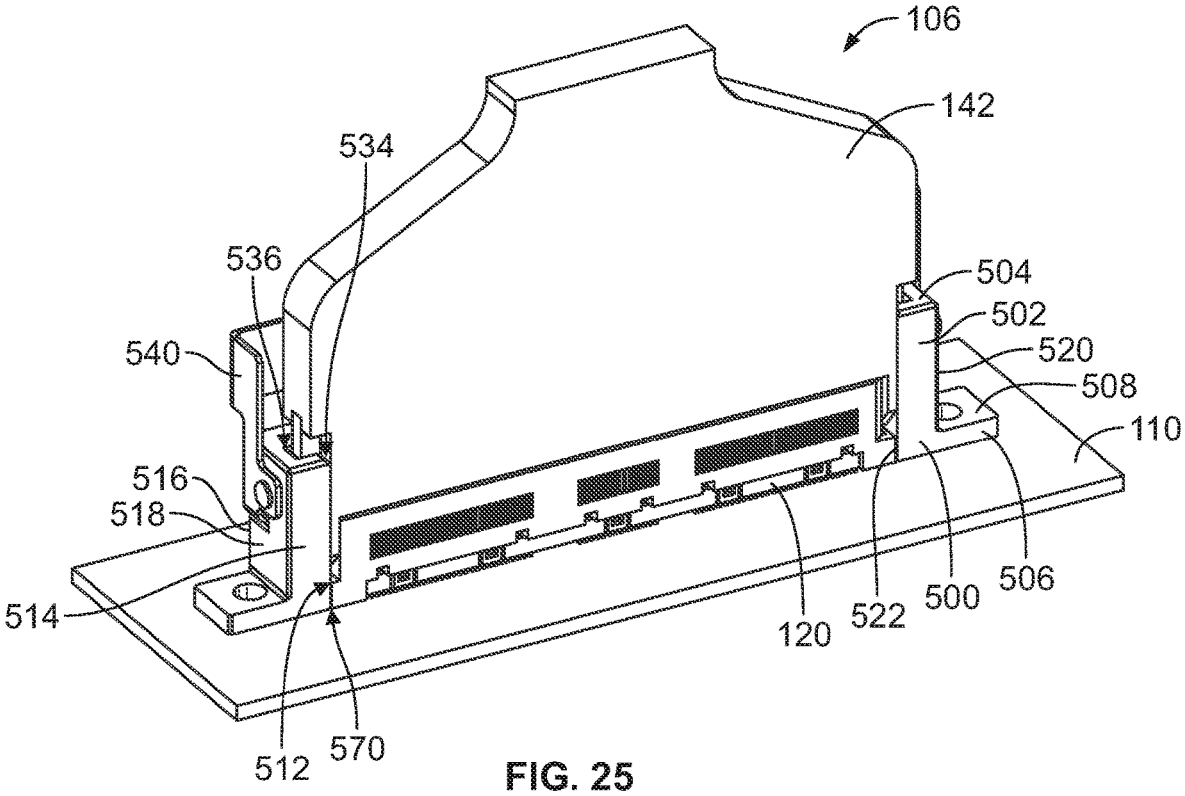
FIG. 25 is a perspective view of the card edge connector assembly showing the card edge connector, the support hardware and the pluggable module in accordance with an exemplary embodiment.
Figure 26:
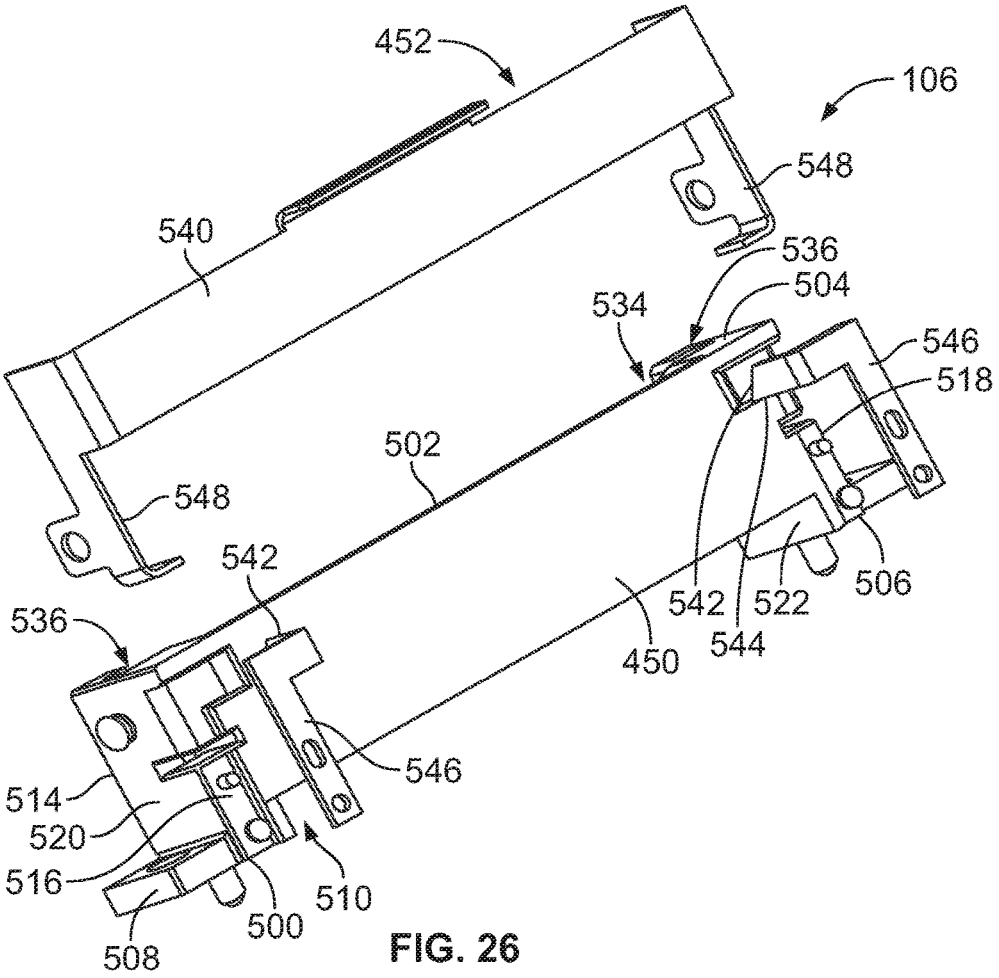
FIG. 26 is an exploded view of the support hardware and the latch in accordance with an exemplary embodiment.

FIG. 25 is a perspective view of the card edge connector assembly 106 showing the card edge connector 120, the support hardware 450 and the cabled pluggable module 142 in accordance with an exemplary embodiment. FIG. 26 is an exploded view of the support hardware 450 and the latch 452.

The support hardware 450 includes a base 500 at a bottom of the support hardware 450 configured to be mounted to the host circuit board 110 (shown in FIGS. 1 and 2) and a support beam 502 above the base 500. The base 500 may be similar to the base 300 and the support beam 502 may be similar to the support beam 302. In an exemplary embodiment, the support hardware 450 is vertical support hardware configured to extend vertically (for example, perpendicular to the host circuit board 110) and be coupled to the pluggable module 122 or 142 in a vertical mating direction. The support beam 502 extends to a distal end or top 504 of the support hardware 450. The top 504 is generally opposite a bottom 506 of the support hardware 450 at the base 500, which is configured to be mounted to the host circuit board 110. In an exemplary embodiment, the bottom 506 includes a mounting feature 508 for mounting the base 500 to the host circuit board 110.

The base 500 includes a cavity 510 configured to receive the card edge connector 120 and one or more openings 512 providing access to the cavity 510. In an exemplary embodiment, the support hardware 450 includes opposite first and second sides 514, 516 extending between ends 518, 520 and between the top 504 and the bottom 506. In the illustrated embodiment, openings 512 are provided at the first and second sides 514, 516. The card edge connector 120 is exposed at the first side 514. The second side 516 may cover at least part of the opposite side of the card edge connector 120 and ties the ends 518, 520 together. The base 500 includes one or more locating surfaces 522 configured to locate the support hardware 450 relative to the card edge connector 120.

The support beam 502 extends between the opposite ends 518, 520 of the support hardware 450. The support beam 502 is used to guide mating of the pluggable module 122 or 142 to the support hardware 450. The support beam 502 supports the pluggable module 122 or 142 to alleviate stresses and strains on the card edge connector 120, such as from pulling on the cables 144 of the pluggable module 142 by transferring the stresses and strains to the base 500 and the host circuit board 110. In an exemplary embodiment, the support beam 502 includes a pocket 534 configured to receive the pluggable module 122 or 142. The pocket 534 is located above the cavity 510 and above the card edge connector 120. Optionally, the pocket 534 is open at the first side 514 and enclosed by the body of the support beam 502 at the second side 516. In an exemplary embodiment, the support beam 502 includes guide channels 536 at the ends 518, 520 that receive portions of the pluggable module 122 or 142.

The latch 452 is coupled to the support beam 502, such as at the second side 516 and extends into the pocket 534 for interfacing with the pluggable module 122 or 142 when received therein. The latch 452 includes a latch handle 540 for actuating the latch 452. In the illustrated embodiment, the latch handle 540 is at the second side 516. The latch handle 540 may be grasped or pushed by the operator to release the latch 452, such as in a direction toward the second side 516; however, the latch handle 540 may be moved in other directions, such as in a direction away from the second side 516. In other embodiments, the latch handle 540 may be coupled to a tether that may be pulled to release the latch 452.

The latch 452 includes latch tabs 546 configured to be coupled to the support beam 502 and/or the base 500. The latch tabs 546 have latching fingers 542 for latchably engaging the pluggable module 122 or 142. The latching fingers 542 extend into the pocket 534 to directly engage the pluggable module 122 or 142. Optionally, the latching fingers 542 may be wedge shaped to passively deflect the latching fingers 542 as the pluggable module 122 or 142 is loaded into the support hardware 450. The latching fingers 542 include latching surfaces 544 configured to engage and latchably couple to the pluggable module 122 or 142 to resist removal of the pluggable module 122 or 142 from the pocket 534. Other types of latching features may be provided in alternative embodiments. The latching features may be located at a different position on the support beam 502 or may be located on the base 500 in alternative embodiments.

In an exemplary embodiment, the latch handle 540 and the latch tabs 546 are a stamped and formed from sheet metal plates; however, the latch handle 540 and/or the latch tabs 546 may be manufactured from other processes and/or materials in alternative embodiments. The latch handle 540 includes arms 548 configured to be mounted to the support hardware 450. For example, the arms 548 may be pivotably coupled to pivots extending from or coupled to the support hardware 450. The arms 548 are configured to engage the latch tabs 546. When the latch handle 540 is moved, such as rotated, the arms 548 press against the latch tabs 546 to move the latch tabs to a released position. For example, the arms 548 press against the latch tabs 546 to move the latching fingers 542 out of the pocket 534 to release the pluggable module 122 or 142. The latch tabs 546 may spring back to last positions when the latch handle 540 is released.

Figure 27:
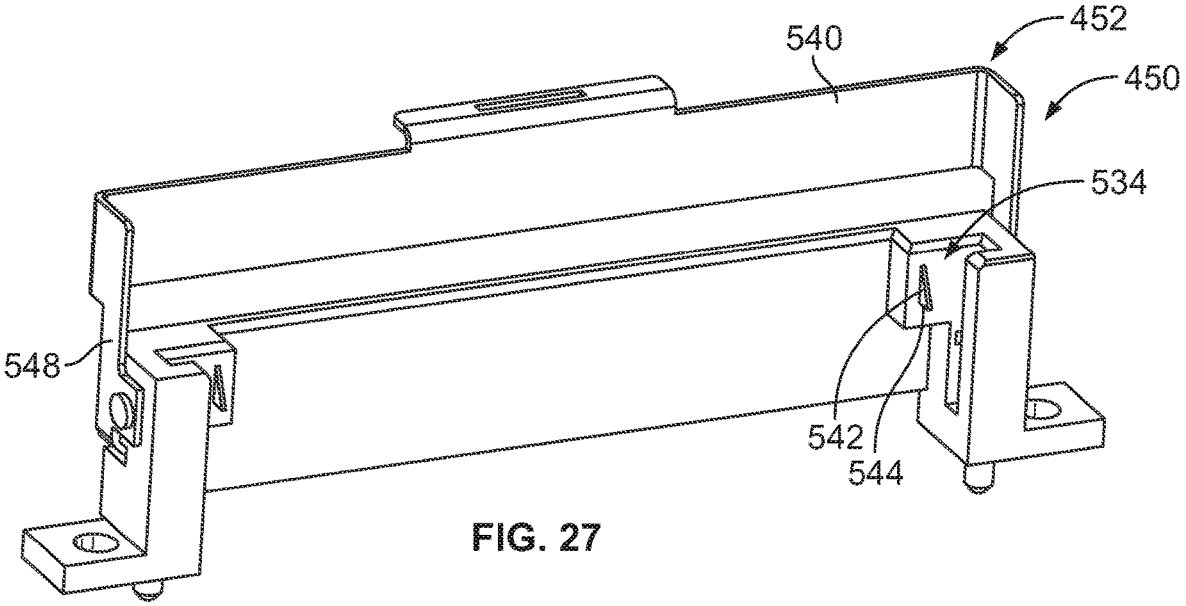
FIG. 27 is a front perspective view of the support hardware showing the latch in a latched position.
Figure 28:
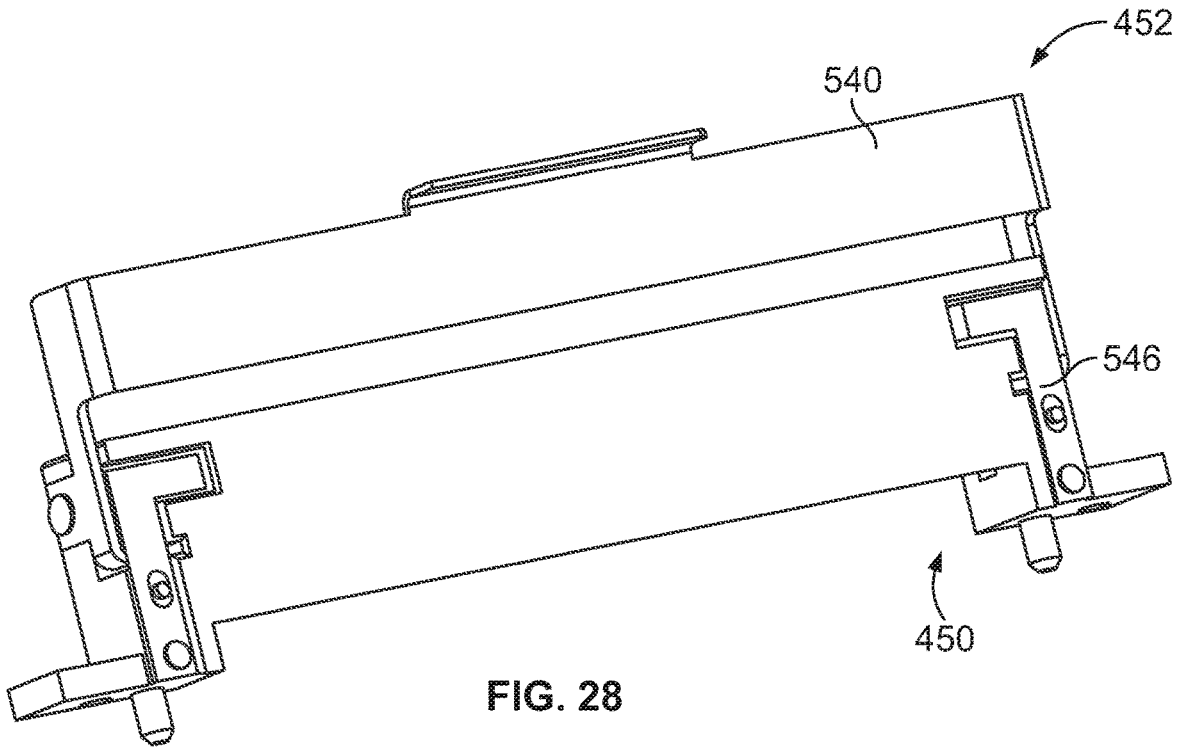
FIG. 28 is a rear perspective view of the support hardware showing the latch in the latched position.
Figure 29:
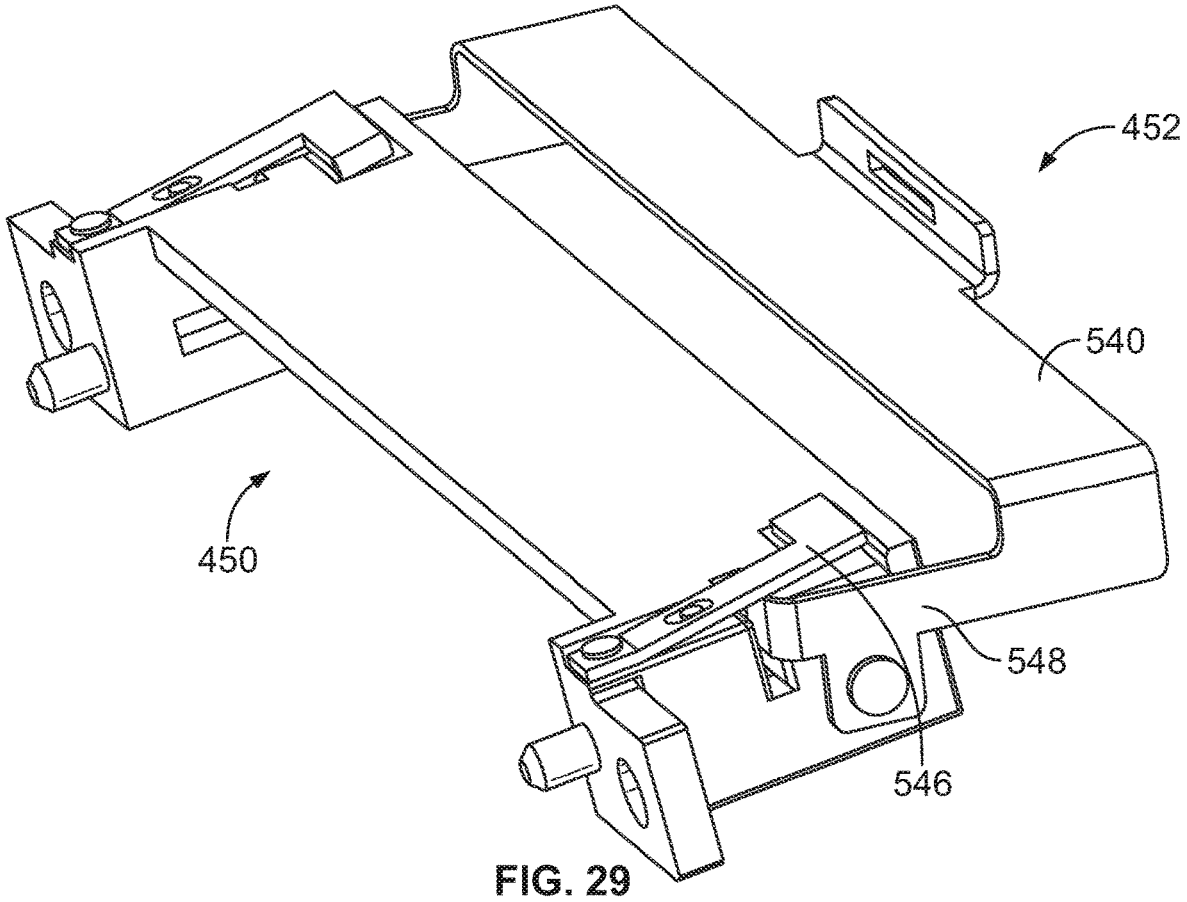
FIG. 29 is a rear perspective view of the support hardware showing the latch in an unlatched or released position.
Figure 30:
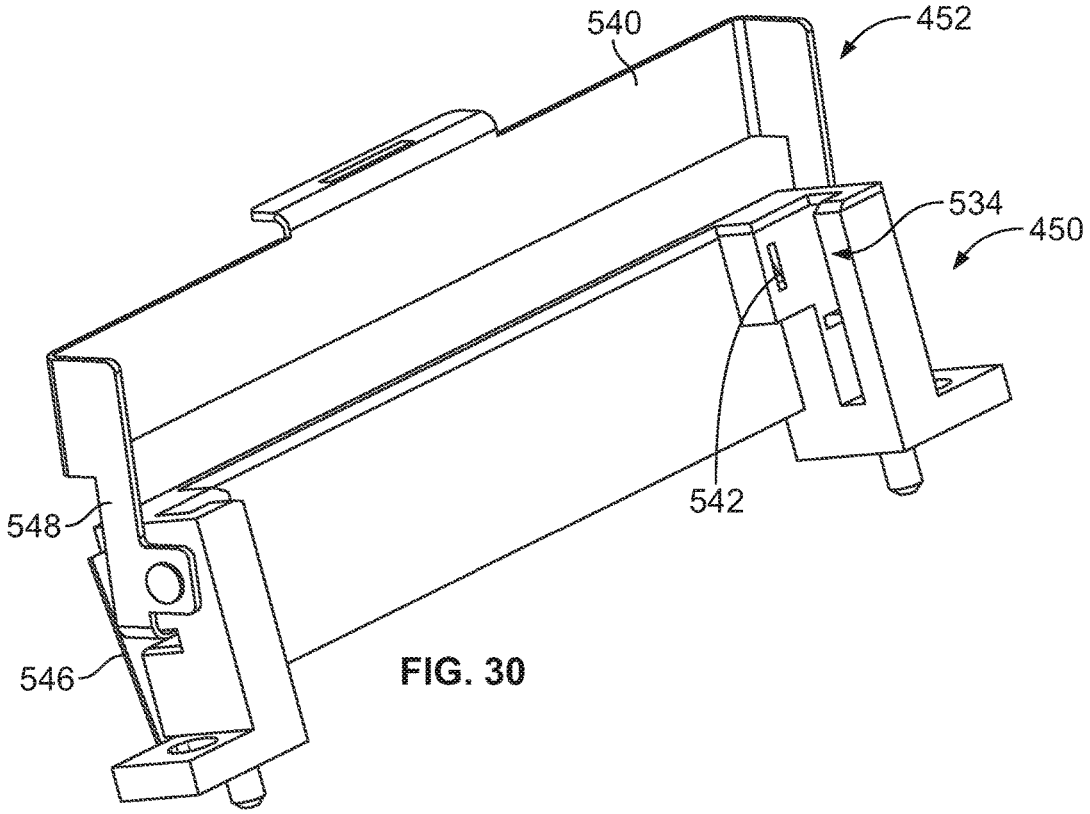
FIG. 30 is a front perspective view of the support hardware showing the latch in the unlatched or released position.

FIG. 27 is a front perspective view of the support hardware 450 showing the latch 452 in a latched position. FIG. 28 is a rear perspective view of the support hardware 450 showing the latch 452 in the latched position. FIG. 29 is a rear perspective view of the support hardware 450 showing the latch 452 in an unlatched or released position. FIG. 30 is a front perspective view of the support hardware 450 showing the latch 452 in the unlatched or released position. The latching fingers 542 extend into the pocket 534 in the latched position. The latching fingers 542 are removed from the pocket 534 and the unlatched or released position. In the illustrated embodiment, the latch handle 540 is pressed forward to pivot or rotate the arms 548 into the latch tabs 546 to release the latching fingers 542.

Figure 31:
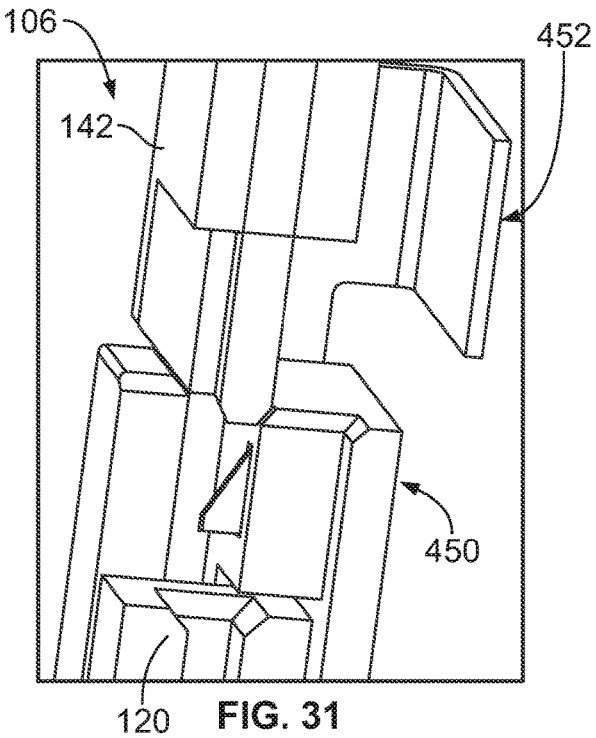
FIG. 31 is a cross-sectional view of a portion of the card edge connector assembly showing the pluggable module poised for coupling to the support hardware and the card edge connector.
Figure 32:
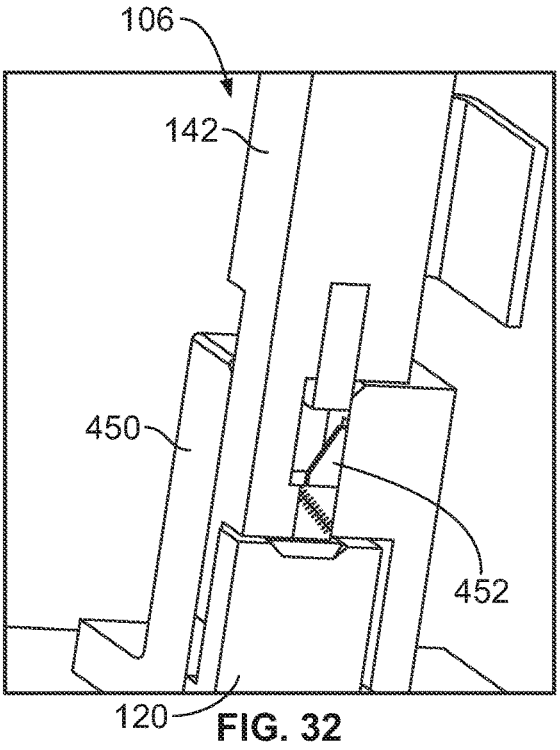
FIG. 32 is a cross-sectional view of a portion of the card edge connector assembly showing the pluggable module coupled to the support hardware and the card edge connector showing the latch in the latched position.
Figure 33:
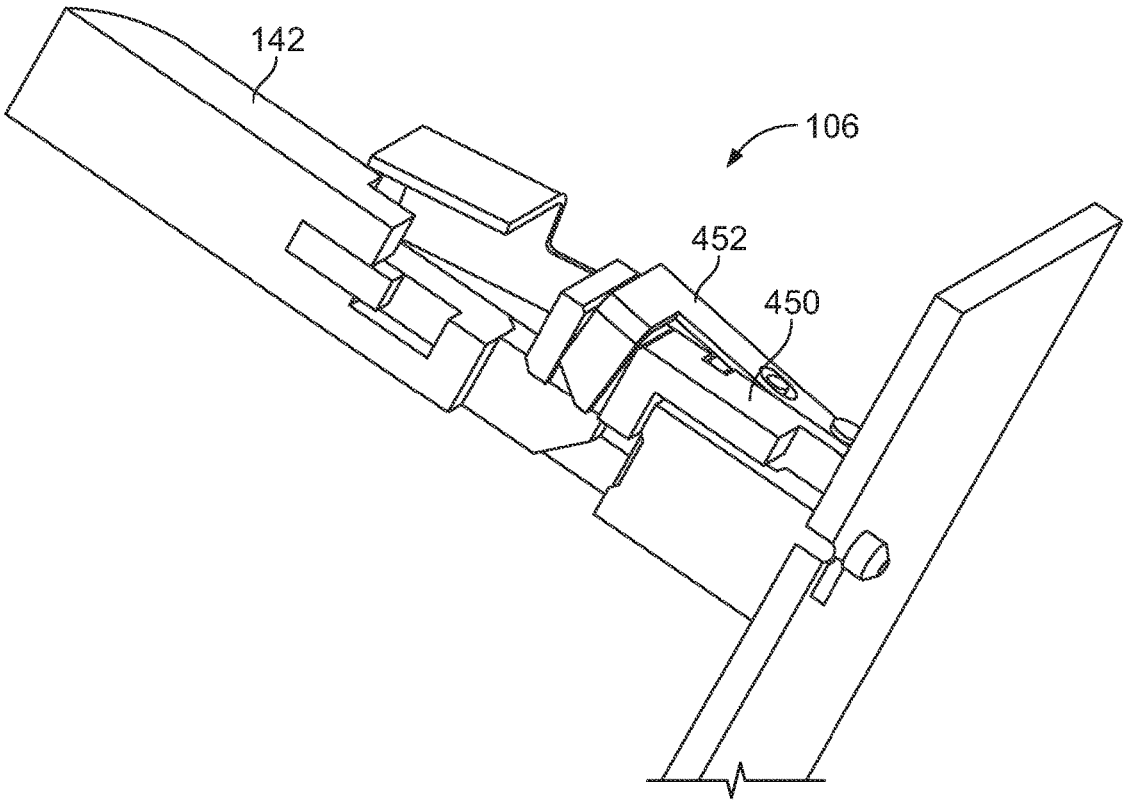
FIG. 33 is a cross-sectional view of a portion of the card edge connector assembly showing the pluggable module coupled to the support hardware and the card edge connector showing the latch in the unlatched or released position.

FIG. 31 is a cross-sectional view of a portion of the card edge connector assembly 106 showing the pluggable module 142 poised for coupling to the support hardware 450 and the card edge connector 120. FIG. 32 is a cross-sectional view of a portion of the card edge connector assembly 106 showing the pluggable module coupled to the support hardware 450 and the card edge connector 120 showing the latch 452 in the latched position. FIG. 33 is a cross-sectional view of a portion of the card edge connector assembly 106 showing the pluggable module 142 coupled to the support hardware 450 and the card edge connector 120 showing the latch 452 in the unlatched or released position to allow the pluggable module 142 to be removed from the support hardware 450.

Figure 34:
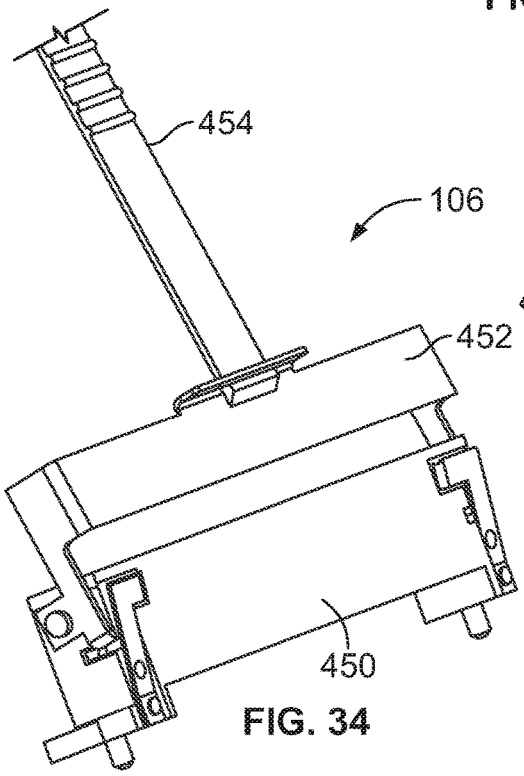
FIG. 34 illustrates a portion of the card edge connector assembly showing the support hardware and the latch in accordance with an exemplary embodiment.

FIG. 34 illustrates a portion of the card edge connector assembly 106 showing the support hardware 450 and the latch 452 with a tether 454 coupled to the latch 452. The tether 454 may be pulled to actuate the latch 452.

Figure 35:
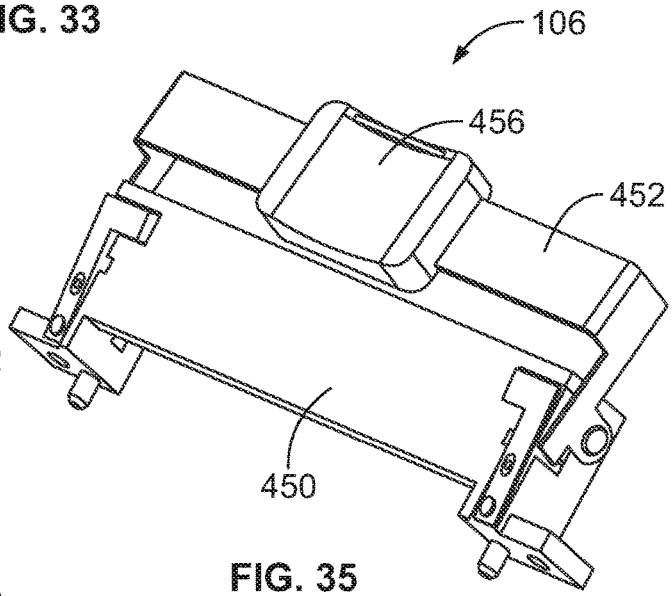
FIG. 35 illustrates a portion of the card edge connector assembly showing the support hardware and the latch in accordance with an exemplary embodiment.

FIG. 35 illustrates a portion of the card edge connector assembly 106 showing the support hardware 450 and the latch 452 with a button 456 coupled to the latch 452. The button 456 may be pressed to actuate the latch 452.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector assembly comprising:

a card edge connector having a housing defining a card slot configured to receive a paddle card of a pluggable module, the housing having a base configured to be mounted to a host circuit board, the housing holding contacts in the card slot to electrically connect to the paddle card; and support hardware coupled to the housing, the support hardware having a base including a cavity receiving the card edge connector, the support hardware having a support beam extending from the base, the support beam having a pocket receiving the pluggable module, the support beam having a support surface configured to support the pluggable module independent of the card edge connector such that the paddle card is oriented in the card slot relative to the contacts for electrical connection therewith, the support hardware having a latch coupled to the support beam latchably coupled to the pluggable module to secure the pluggable module in the support hardware electrically coupled to the card edge connector, wherein the latch includes a latch handle and a latch tab coupled to the latch handle, the latch tab having a latching finger extending into the pocket to engage the pluggable module to latchably secure the pluggable module in the support hardware, the latch being actuated to retract the latching finger out of the pocket to remove the pluggable module from the pocket.

2. The card edge connector assembly of claim 1, wherein the support hardware registers the pluggable module relative to the card edge connector and supports the pluggable module to hold the paddle card relative to the contacts.

3. The card edge connector assembly of claim 1, wherein the support hardware is registered to the housing of the card edge connector by a locating surface of the support hardware engaging a locating surface of the housing.

4. The card edge connector assembly of claim 1, wherein the base of the support hardware is secured to the host circuit board independent of the card edge connector.

5. The card edge connector assembly of claim 1, wherein the latch includes a latch handle at a first side of the support hardware.

6. The card edge connector assembly of claim 1, wherein the latch includes a latch handle and a latch tab coupled to the latch handle, the latch tab having a latching finger configured to engage the pluggable module to latchably secure the pluggable module in the support hardware.

7. The card edge connector assembly of claim 1, wherein the latch includes a latch handle and a latch tab coupled to the latch handle, the latch tab having a latching finger configured to engage the pluggable module to latchably secure the pluggable module in the support hardware, the latch handle having a tether coupled thereto configured to pull the latch handle and the latch tab to release the pluggable module.

8. The card edge connector assembly of claim 1, wherein the latch is pulled away from the support hardware in a release direction perpendicular to a mating direction of the pluggable module with the card edge connector.

9. The card edge connector assembly of claim 1, wherein the latch includes a biasing member biasing the latch to a latched position.

10. The card edge connector assembly of claim 1, wherein the latch includes a latching finger configured to directly engage the paddle card of the pluggable module to latchably secure the pluggable module in the support hardware.

11. The card edge connector assembly of claim 1, wherein the support beam is positioned vertically above the base of the support hardware to receive the pluggable module in a mating direction perpendicular to the host circuit board.

12. The card edge connector assembly of claim 1, wherein the support beam extends from the base of the support hardware generally parallel to the host circuit board.

13. The card edge connector assembly of claim 1, wherein the support hardware transfers forces from the pluggable module to the host circuit board independent of the card edge connector.

14. The card edge connector assembly of claim 1, further comprising the pluggable module having a pluggable body holding the paddle card received in the card slot of the housing, the pluggable body having a rib at an end thereof, the rib being received in a guide channel in the pocket of the support hardware to position the pluggable module in the pocket.

15. The card edge connector assembly of claim 1, further comprising the pluggable module having a pluggable body holding the paddle card received in the card slot of the housing, the pluggable body having a keying feature providing keyed mating of the pluggable module with the support hardware.

16. A card edge connector assembly comprising:

a card edge connector having a housing defining a card slot configured to receive a paddle card of a pluggable module, the housing having a base configured to be mounted to a host circuit board, the housing holding contacts in the card slot to electrically connect to the paddle card, the housing having a locating surface on an exterior of the housing; and support hardware coupled to the housing, the support hardware having a base including a cavity receiving the card edge connector, the support hardware includes a locating surface in the cavity engaging the locating surface of the housing to register the location of the support hardware to the card edge connector, the support hardware having a support beam extending from the base, the support beam having a pocket receiving the pluggable module, the support beam having a support surface configured to support the pluggable module independent of the card edge connector such that the paddle card is oriented in the card slot relative to the contacts for electrical connection therewith, the support hardware having a latch coupled to the support beam latchably coupled to the pluggable module to secure the pluggable module in the support hardware electrically coupled to the card edge connector, wherein the latch includes a latch handle and a latch tab coupled to the latch handle, the latch tab having a latching finger configured to engage the pluggable module to latchably secure the pluggable module in the support hardware, the latch handle having a tether coupled thereto configured to pull the latch handle and the latch tab to release the pluggable module.

17. The card edge connector assembly of claim 16, wherein the support hardware registers the pluggable module relative to the card edge connector and supports the pluggable module to hold the paddle card relative to the contacts.

18. The card edge connector assembly of claim 16, wherein the support beam extends from the base of the support hardware generally parallel to the host circuit board.

19. The card edge connector assembly of claim 16, wherein the latching finger extends into the pocket to engage the pluggable module, the latch being actuated to retract the latching finger out of the pocket to remove the pluggable module from the pocket.

20. A card edge connector assembly comprising:

a card edge connector having a housing defining a card slot configured to receive a paddle card of a pluggable module, the housing having a base configured to be mounted to a host circuit board, the housing holding contacts in the card slot to electrically connect to the paddle card; and support hardware coupled to the housing, the support hardware having a base including a cavity receiving the card edge connector, the support hardware having a support beam extending from the base, the support beam having a pocket receiving the pluggable module, the support beam having a support surface configured to support the pluggable module independent of the card edge connector such that the paddle card is oriented in the card slot relative to the contacts for electrical connection therewith, the support hardware having a latch coupled to the support beam latchably coupled to the pluggable module to secure the pluggable module in the support hardware electrically coupled to the card edge connector, the latch being pivoted toward the pluggable module to release from the pluggable module.

21. The card edge connector assembly of claim 20, wherein the latch includes a latch handle and a latch tab coupled to the latch handle, the latch tab having a latching finger configured to engage the pluggable module to latchably secure the pluggable module in the support hardware.

22. The card edge connector assembly of claim 20, wherein the latch includes a latch handle and a latch tab coupled to the latch handle, the latch tab having a latching finger extending into the pocket to engage the pluggable module to latchably secure the pluggable module in the support hardware, the latch being actuated to retract the latching finger out of the pocket to remove the pluggable module from the pocket.

23. The card edge connector assembly of claim 20, wherein the latch includes a latch handle and a latch tab coupled to the latch handle, the latch tab having a latching finger configured to engage the pluggable module to latchably secure the pluggable module in the support hardware, the latch handle having a tether coupled thereto configured to pull the latch handle and the latch tab to release the pluggable module.

24. The card edge connector assembly of claim 20, wherein the support beam extends from the base of the support hardware generally parallel to the host circuit board.

* * * * *